US009348260B2

(12) United States Patent
Eto

(10) Patent No.: US 9,348,260 B2
(45) Date of Patent: May 24, 2016

(54) DEVELOPER CONTAINER AND IMAGE FORMING APPARATUS INCLUDING THE SAME

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/812,585

(22) Filed: Jul. 29, 2015

(65) Prior Publication Data

US 2016/0033897 A1 Feb. 4, 2016

(30) Foreign Application Priority Data

Jul. 30, 2014 (JP) ..... 2014-154763

(51) Int. Cl.
*G03G 15/08* (2006.01)

(52) U.S. Cl.
CPC ..... *G03G 15/0865* (2013.01); *G03G 15/0893* (2013.01); *G03G 2215/0838* (2013.01)

(58) Field of Classification Search
CPC ..... G03G 15/1865; G03G 15/0877; G03G 15/0881; G03G 15/0889
See application file for complete search history.

(56) References Cited

U.S. PATENT DOCUMENTS

| | | | | |
|---|---|---|---|---|
| 7,929,899 | B2 | 4/2011 | Fukunaga et al. | |
| 2009/0269112 | A1 | 10/2009 | Fukunaga et al. | |
| 2014/0079441 | A1* | 3/2014 | Abler | G03G 15/0875 399/262 |

FOREIGN PATENT DOCUMENTS

| | | | |
|---|---|---|---|
| JP | 2003-280344 | A | 10/2003 |
| JP | 2009-265395 | A | 11/2009 |

* cited by examiner

*Primary Examiner* — David Gray
*Assistant Examiner* — Thomas Giampaolo, II
(74) *Attorney, Agent, or Firm* — Studebaker & Brackett PC

(57) ABSTRACT

A toner container includes a container body, a toner discharge outlet, and a moveable wall. The container body includes an inner circumferential section having a tubular shape extending in a first direction and an internal space. The toner discharge outlet passes through the container body. The moveable wall includes a conveying surface and an outer circumferential section in sealed contact with the inner circumferential section of the container body. The moveable wall moves in the first direction along a shaft while conveying developer toward the toner discharge outlet. The shaft includes a moveable wall support section that supports the moveable wall when the moveable wall reaches a final position.

10 Claims, 24 Drawing Sheets

DEVELOPER CONTAINER AND IMAGE FORMING APPARATUS INCLUDING THE SAME

INCORPORATION BY REFERENCE

The present application claims priority under 35 U.S.C. §119 to Japanese Patent Application No. 2014-154763, filed on Jul. 30, 2014. The contents of this application are incorporated herein by reference in their entirety.

BACKGROUND

The present disclosure relates to developer containers that contain developer in an inner section thereof and image forming apparatuses that include such a developer container.

A toner container is a commonly known example of a developer container that contains developer in an inner section thereof. The toner container includes a toner discharge outlet and a rotatable stirring member. Rotation of the stirring member causes discharge of toner through the toner discharge outlet.

A waste toner container is another commonly known example of a developer container that contains developer in an inner section thereof. In one example, a waste toner container includes a container body having a circular tubular shape and a helical groove formed on an outer circumferential section of the container body. Upon rotation of the container body, collected toner is conveyed along the helical groove to one end of the container body.

SUMMARY

A developer container according to the present disclosure includes a container body, a cap, a developer discharge outlet, a shaft, a drive transmission member, a moveable wall, a bearing, a moveable wall stopping section, and a tilt restricting mechanism. The container body includes an inner circumferential section, an internal space, and a wall section. The inner circumferential section has a tubular shape extending in a first direction. The internal space is defined by the inner circumferential section. The wall section defines one end surface of the internal space in the first direction. The cap is attached at an opposite end of the container body to the wall section in the first direction. The cap closes the internal space. The developer discharge outlet is provided in a lower surface of the container body so as to pass through the inner circumferential section. The developer discharge outlet is located in proximity to the cap or the wall section in the first direction. Developer is discharged through the developer discharge outlet. The shaft has an external thread on an outer circumferential surface thereof. The shaft is rotatably supported on the wall section and the cap such as to extend in the internal space in the first direction. The drive transmission member transmits rotational driving force to the shaft. The moveable wall includes an outer circumferential section and a conveying surface. The outer circumferential section is in sealed contact with the inner circumferential section of the container body. The conveying surface is at a downstream side in the first direction. The conveying surface, in conjunction with the inner circumferential section of the container body, defines a containment space in which developer is contained. The moveable wall moves in the first direction from an initial position at one side of the internal space to a final position at another side of the internal space while conveying the developer toward the developer discharge outlet. The bearing supports the moveable wall and has an internal thread on an inner circumferential surface thereof that engages with the external thread. The shaft extends through the bearing. The moveable wall stopping section is located at a position corresponding to the final position of the moveable wall. The moveable wall stopping section is a section of the shaft along which the external thread is not present. The tilt restricting mechanism restricts the conveying surface of the moveable wall from tilting relative to the first direction when the moveable wall has reached the final position. Upon rotation of the shaft, the moveable wall moves in the first direction along the shaft through engagement of the external thread with the internal thread. When the bearing reaches the moveable wall stopping section, the external thread disengages from the internal thread such that the moveable wall is stopped at the final position.

An image forming apparatus according to the present disclosure includes the developer container described above, an image bearing member, a developing device, and a transfer section. The image bearing member has a surface on which an electrostatic latent image is formed and that bears a developer image. The developing device receives developer from the developer container. The developing device supplies the developer to the image bearing member. The transfer section transfers the developer image onto a sheet from the image bearing member.

DETAILED DESCRIPTION

Figure 1:
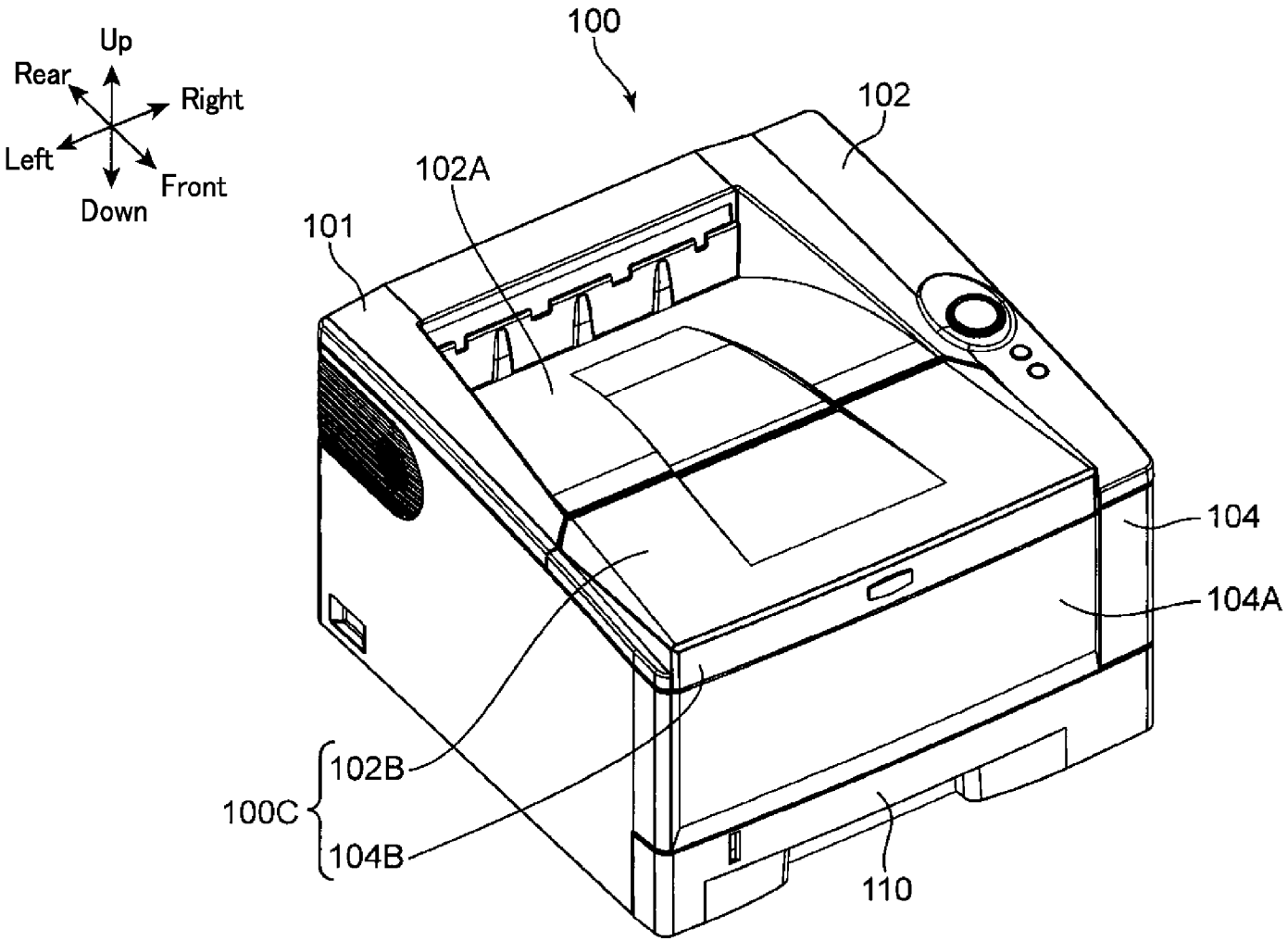
FIG. 1 is a perspective view illustrating an image forming apparatus according to an embodiment of the present disclosure.

The following explains an embodiment of the present disclosure with reference to the drawings. Elements that are the same or equivalent are marked using the same reference signs in the drawings and explanation thereof is not repeated.

Figure 2:
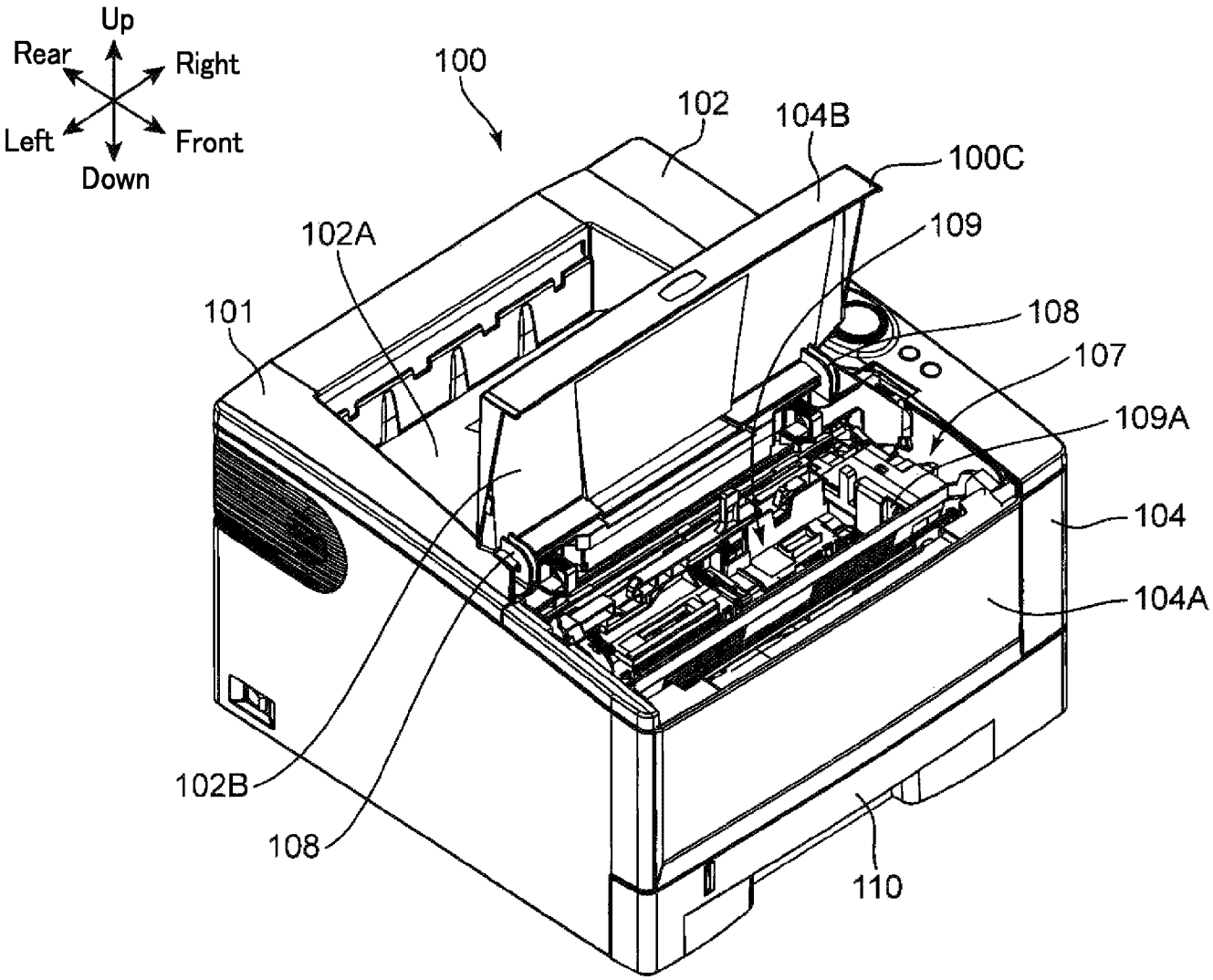
FIG. 2 is a perspective view illustrating the image forming apparatus according to the embodiment of the present disclosure with one part of the image forming apparatus open.
Figure 3:
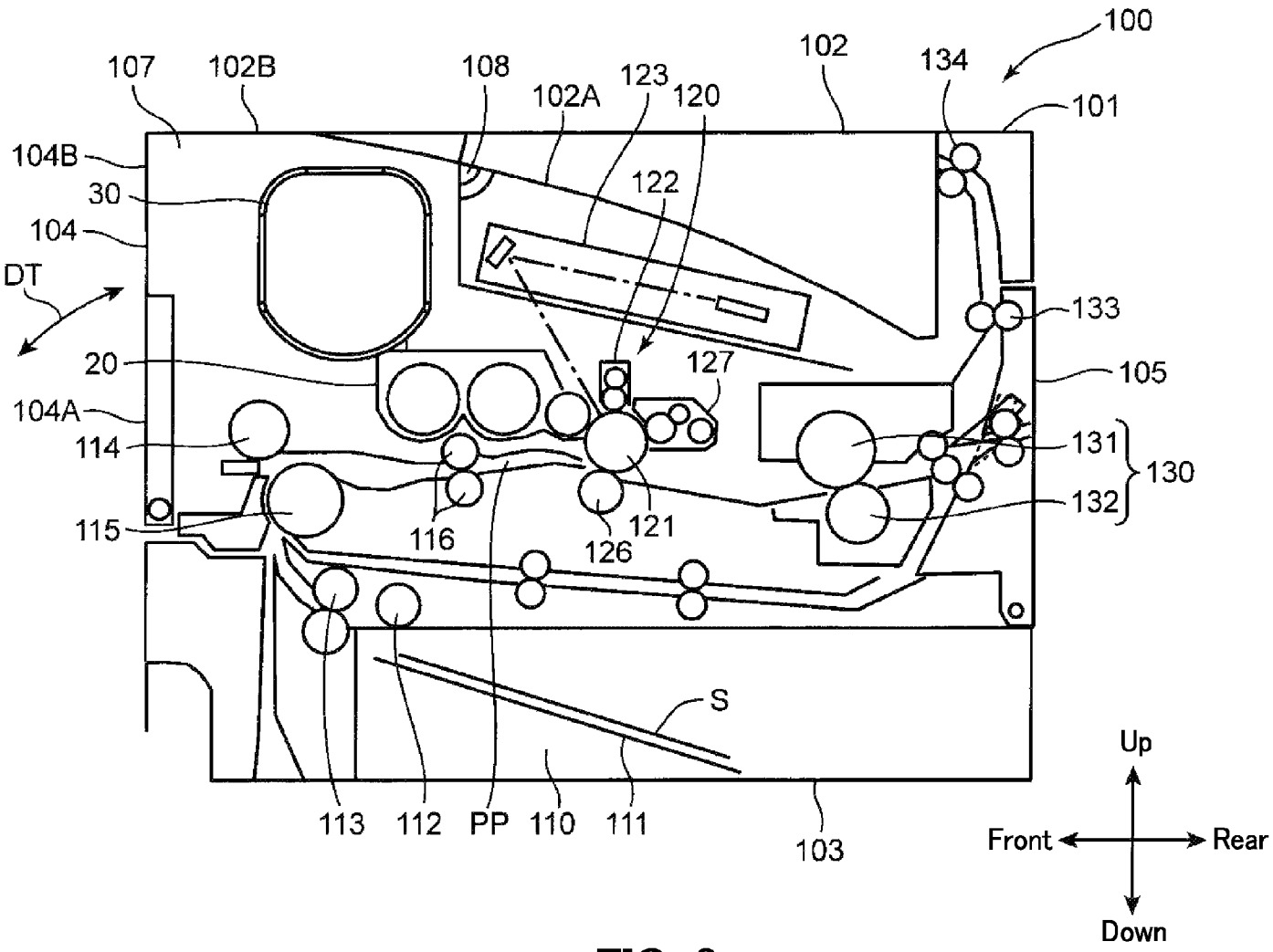
FIG. 3 is a cross-sectional view schematically illustrating internal structure of the image forming apparatus according to the embodiment of the present disclosure.

FIGS. 1 and 2 are perspective views illustrating a printer 100 (image forming apparatus) according to the embodiment of the present disclosure. FIG. 3 is a cross-sectional view roughly illustrating internal structure of the printer 100 illustrated in FIGS. 1 and 2. The printer 100 illustrated in FIGS. 1-3 as an example of the image forming apparatus is a monochrome printer. In another embodiment, the image forming apparatus may be a color printer, a facsimile machine, a multifunction peripheral that functions as a color printer and a facsimile machine, or any other apparatus that forms toner images on sheets. Terms used to indicate directions such as "up", "down", "front", "rear", "left", and "right" are simply used in order to clarify explanation and are not intended to limit the general principles of the image forming apparatus.

The printer 100 includes a casing 101. The casing 101 houses various devices that are used to form an image on a sheet S. The casing 101 includes a top wall 102, a bottom wall 103 (FIG. 3), a body rear wall 105 (FIG. 3), and a body front wall 104. The top wall 102 constitutes a top surface of the casing 101. The bottom wall 103 constitutes a bottom surface of the casing 101. The body rear wall 105 is located between the top wall 102 and the bottom wall 103. The body front wall 104 is located in front of the body rear wall 105. The casing 101 has a body internal space 107. The various devices are located in the body internal space 107 of the casing 101. A sheet conveyance path PP extends through the body internal space 107 of the casing 101. A sheet S is conveyed along the sheet conveyance path PP in a specific conveyance direction. The printer 100 also includes an openable cover 100C. The openable cover 100C is attached to the casing 101 such as to be freely openable and closable relative to the casing 101.

The openable cover 100C includes a front wall upper section 104B and a top wall front section 102B. The front wall upper section 104B is an upper part of the body front wall 104. The top wall front section 102B is a front part of the top wall 102. The openable cover 100C is openable and closable in an up/down direction about a hinge shaft (not illustrated) as a fulcrum (FIG. 2). The hinge shaft is located on a pair of arm sections 108 at opposite ends of the hinge shaft in a right/left direction. When the openable cover 100C is in an open state, an upper section of the body internal space 107 is externally exposed. On the other hand, when the openable cover 200C is in a closed state, the upper section of the body internal space 107 is closed.

A paper discharge section 102A is located in a central section of the top wall 102. The paper discharge section 102A is an inclined surface that is inclined downward from a front part of the top wall 102 toward a rear part of the top wall 102. Once an image has been formed on a sheet S by an image forming section 120 explained further below, the sheet S is discharged onto the paper discharge section 102A. In addition, a manual feed tray 104A is located in a central section in the up/down direction of the body front wall 104. The manual feed tray 104A is pivotable upward and downward relative to the body front wall 104 about a lower end of the manual feed tray 104A as a fulcrum (arrow DT in FIG. 3).

As illustrated in FIG. 3, the printer 100 includes a cassette 110, a pickup roller 112, a pair of first paper feed rollers 113, a second paper feed roller 114, a conveyance roller 115, a pair of registration rollers 116, the image forming section 120, and a fixing device 130.

A sheet S is stored in an inner section of the cassette 110. The cassette 110 includes a lift plate 111. The lift plate 111 is inclined such as to push a leading edge of the sheet S upward. The cassette 110 can be pulled out of the casing 101 in a forward direction.

The image forming section 120 includes a photosensitive drum 121 (image bearing member), a charger 122, a light exposure device 123, a developing device 20, a toner container 30 (developer container), a transfer roller 126 (transfer section), and a cleaning device 127.

The fixing device 130 is located further downstream in the conveyance direction than the image forming section 120. The fixing device 130 fixes a toner image to a sheet S. The fixing device 130 includes a heating roller 131 and a pressure roller 132. The heating roller 131 melts toner on the sheet S. The pressure roller 132 presses the sheet S against the heating roller 131.

The printer 100 further includes a pair of conveyance rollers 133 and a pair of discharge rollers 134. The pair of conveyance rollers 133 are located downstream of the fixing device 130. The pair of discharge rollers 134 are located downstream of the pair of conveyance rollers 133. The pair of conveyance rollers 133 conveys the sheet S upward. Finally, the pair of discharge rollers 134 discharges the sheet S from the casing 101. Upon being discharged from the casing 101, the sheet S is stacked on the paper discharge section 102A.

<Developing Device>

Figure 4:
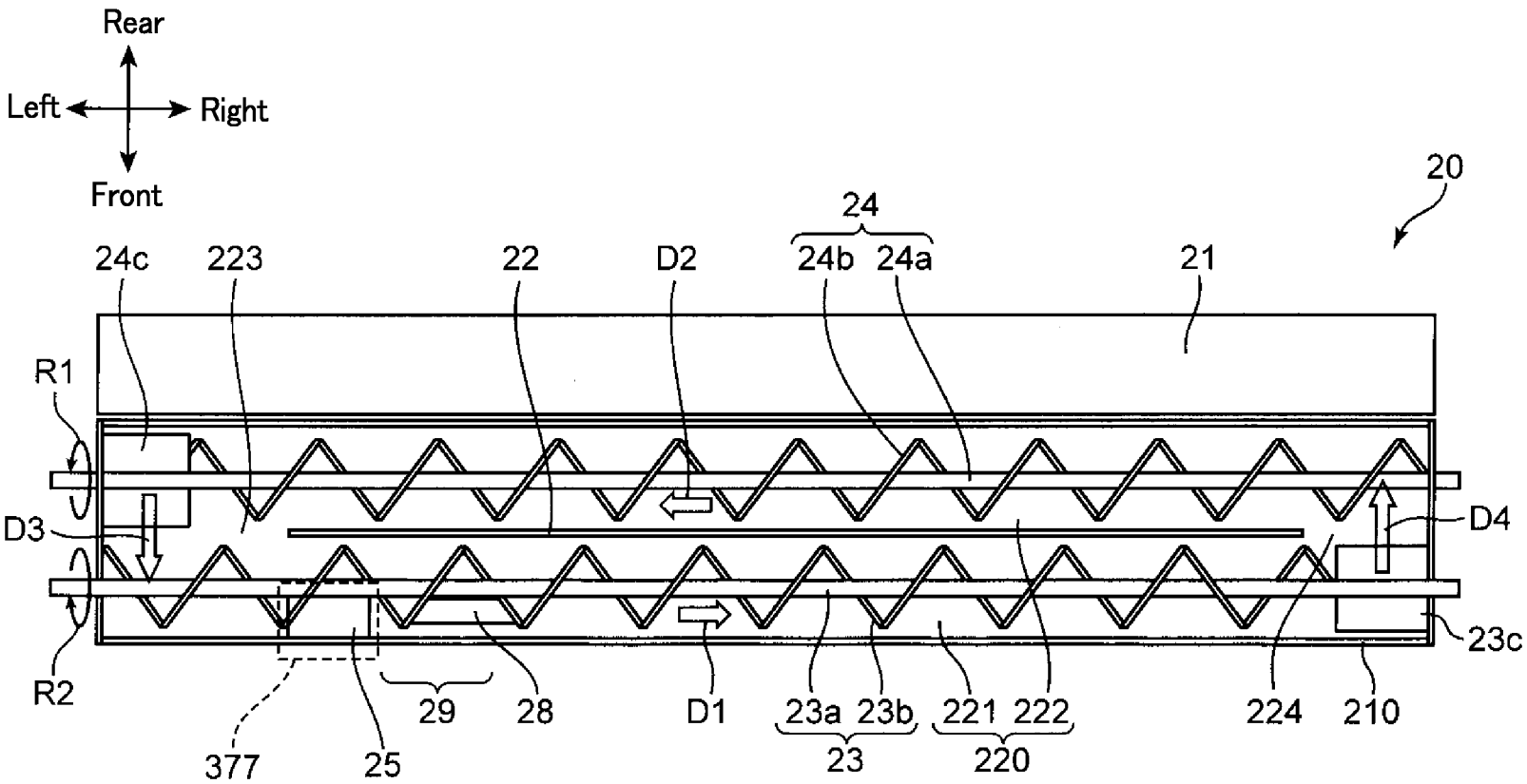
FIG. 4 is a plan view schematically illustrating internal structure of a developing device according to the embodiment of the present disclosure.

FIG. 4 is a plan view illustrating internal structure of the developing device 20. The developing device 20 includes a development housing 210. The development housing 210 has a box-like shape that is elongated in one direction (axial direction of development roller 21, right/left direction). The development housing 210 has a reservoir space 220. The development roller 21, a first stirring screw 23, a second stirring screw 24, and a toner replenishment inlet 25 are located in the reservoir space 220. The developing device 20 adopts a one component development method in the present embodiment. The reservoir space 220 is filled with a toner as a developer. In contrast, in a situation in which a two component development method is adopted, the reservoir space 220 is filled with a mixture of a toner and a carrier formed from a magnetic material as a developer. The toner is subjected to stirred conveyance in the reservoir space 220. The toner is supplied gradually from the development roller 21 to the photosensitive drum 121 in order to develop an electrostatic latent image.

The development roller 21 has a circular tubular shape that extends in the longitudinal direction of the development housing 210. The development roller 21 includes a rotationally driven sleeve that constitutes an outer circumference of the development roller 21.

The reservoir space 220 of the development housing 210 is covered by a top plate (not illustrated). The reservoir space 220 is partitioned into a first conveyance channel 221 and a second conveyance channel 222 by a partitioning plate 22 that extends in the right/left direction. The first conveyance channel 221 and the second conveyance channel 222 are elongated in the right/left direction. The partitioning plate 22 has a shorter length than the development housing 210 in the right/left direction. A first communication channel 223 and a second communication channel 224 are respectively provided at a left end and a right end of the partitioning plate 22. The first communication channel 223 and the second communication channel 224 each connect the first conveyance channel 221 and the second conveyance channel 222. Through the above configuration, a circulation channel that extends along the first conveyance channel 221, the second communication channel 224, the second conveyance channel 222, and the first communication channel 223 is formed in the reservoir space 220. Toner is conveyed along the circulation channel in a direction corresponding to counter-clockwise in FIG. 4.

The toner replenishment inlet 25 (developer replenishment inlet) is an opening in the top plate of the development housing 210. The toner replenishment inlet 25 is located above the first conveyance channel 221 in proximity to a left end of the first conveyance channel 221. The toner replenishment inlet 25 faces the circulation channel. The toner replenishment inlet 25 has a function of receiving replenishment toner (replenishment developer) into the reservoir space 220 that is supplied through a toner discharge outlet 377 of the toner container 30.

The first stirring screw 23 is located in the first conveyance channel 221. The first stirring screw 23 includes a first rotatable shaft 23*a* and a first helical blade 23*b* (screw blade). The first helical blade 23*b* is provided around the circumference of the first rotatable shaft 23*a* in a helical shape. The first stirring screw 23 is rotationally driven around the first rotatable shaft 23*a* (arrow R2) such as to convey toner in a direction indicated by arrow D1 in FIG. 4. The first stirring screw 23 conveys the toner past a position at which the toner replenishment inlet 25 faces the first conveyance channel 221. Through the above configuration, the first stirring screw 23 has a function of mixing new toner flowing in through the toner replenishment inlet 25 and toner conveyed into the first conveyance channel 221 from the second conveyance channel 222 while conveying the mixed toners. A first paddle 23*c* is located at a downstream end in the toner conveyance direction (direction D1) of the first stirring screw 23. The first paddle 23*c* is a plate-shaped member that is located on the first rotatable shaft 23*a*. The first paddle 23*c* rotates in accompaniment to the first rotatable shaft 23*a*. The first paddle 23*c* transfers toner into the second conveyance channel 222 from the first conveyance channel 221 in a direction indicated by arrow D4 in FIG. 4.

The second stirring screw 24 is located in the second conveyance channel 222. The second stirring screw 24 includes a second rotatable shaft 24*a* and a second helical blade 24*b*. The second helical blade 24*b* is provided around the circumference of the second rotatable shaft 24*a* in a helical shape. The second stirring screw 24 is rotationally driven around the second rotatable shaft 24*a* (arrow R1) such as to supply toner to the development roller 21 while conveying the toner in a direction indicated by arrow D2 in FIG. 4. A second paddle 24*c* is located at a downstream end in the toner conveyance direction (direction D2) of the second stirring screw 24. The second paddle 24*c* rotates in accompaniment to the second rotatable shaft 24*a*. The second paddle 24*c* transfers toner into the first conveyance channel 221 from the second conveyance channel 222 in a direction indicated by arrow D3 in FIG. 4.

The toner container 30 (FIG. 3) is located above the toner replenishment inlet 25 of the development housing 210. The toner container 30 includes the aforementioned toner discharge outlet 377 (FIG. 4). The toner discharge outlet 377 is provided in a bottom section 371 (FIG. 8B) of the toner container 30 at a position corresponding to the toner replenishment inlet 25 of the developing device 20. Toner that drops through the toner discharge outlet 377 is supplied into the developing device 20 through the toner replenishment inlet 25.

<Toner Replenishment>

Figure 5:
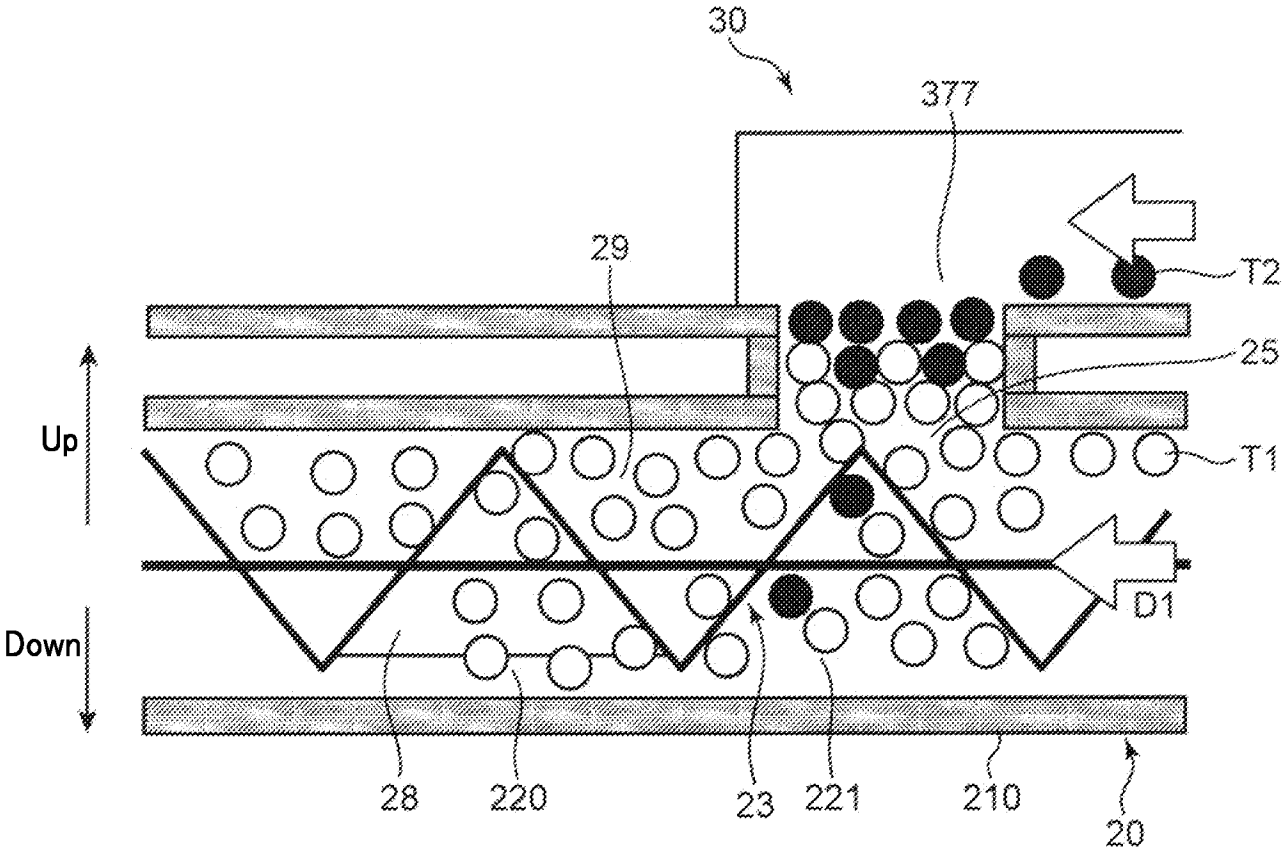
FIG. 5 is a cross-sectional view schematically illustrating replenishment of developer in the developing device according to the embodiment of the present disclosure.

The following explains the flow of new toner supplied through the toner replenishment inlet 25 with reference to FIG. 5. FIG. 5 is a cross-sectional view illustrating a region in proximity to the toner replenishment inlet 25 of the developing device 20 and the toner discharge outlet 377 of the toner container 30.

Replenishment toner T2 is supplied through the toner discharge outlet 377 of the toner container 30. The replenishment toner T2 drops into the first conveyance channel 221 where the replenishment toner T2 is mixed with existing toner T1 and conveyed in the direction indicated by arrow D1 by the first stirring screw 23. In the above situation, the toner T1 and the toner T2 are stirred and charged.

The first stirring screw 23 includes a limiting paddle 28 (conveyance limiting member) located further downstream in the toner conveyance direction than the toner replenishment inlet 25. The limiting paddle 28 (conveyance limiting member) partially limits toner conveyance. The limiting paddle 28 in the present embodiment is a plate-shaped member that extends between adjacent sections of the first helical blade 23*b* of the first stirring screw 23. Rotation of the limiting paddle 28 around the first rotatable shaft 23*a* causes stagnation of toner that has been conveyed from upstream of the limiting paddle 28. The stagnated toner accumulates up to a position just upstream of the limiting paddle 28 at which the toner replenishment inlet 25 faces the first conveyance channel 221. Consequently, a stagnant region 29 of toner (stagnant developer region) is formed in proximity to the toner replenishment inlet 25.

When replenishment toner T2 is supplied through the toner replenishment inlet 25, the amount of toner in the reservoir space 220 increases and, as a result, stagnant toner in the stagnant region 29 blocks (seals) the toner replenishment inlet 25 and prevents any more toner from being supplied. Upon subsequent consumption of toner in the reservoir space 220 from the development roller 21, the amount of stagnant toner in the stagnant region 29 decreases and the amount of toner blocking the toner replenishment inlet 25 decreases, thereby creating a gap between the stagnant region 29 and the toner replenishment inlet 25. Consequently, replenishment toner T2 once again flows into the reservoir space 220 through the toner replenishment inlet 25. As described above, the present embodiment adopts volume replenishment-type toner replenishment in which the amount of replenishment toner that is received is adjusted in accordance with a decrease in the amount of stagnant toner in the stagnant region 29.

<Attachment of Toner Container to Developing Device>

Figure 6:
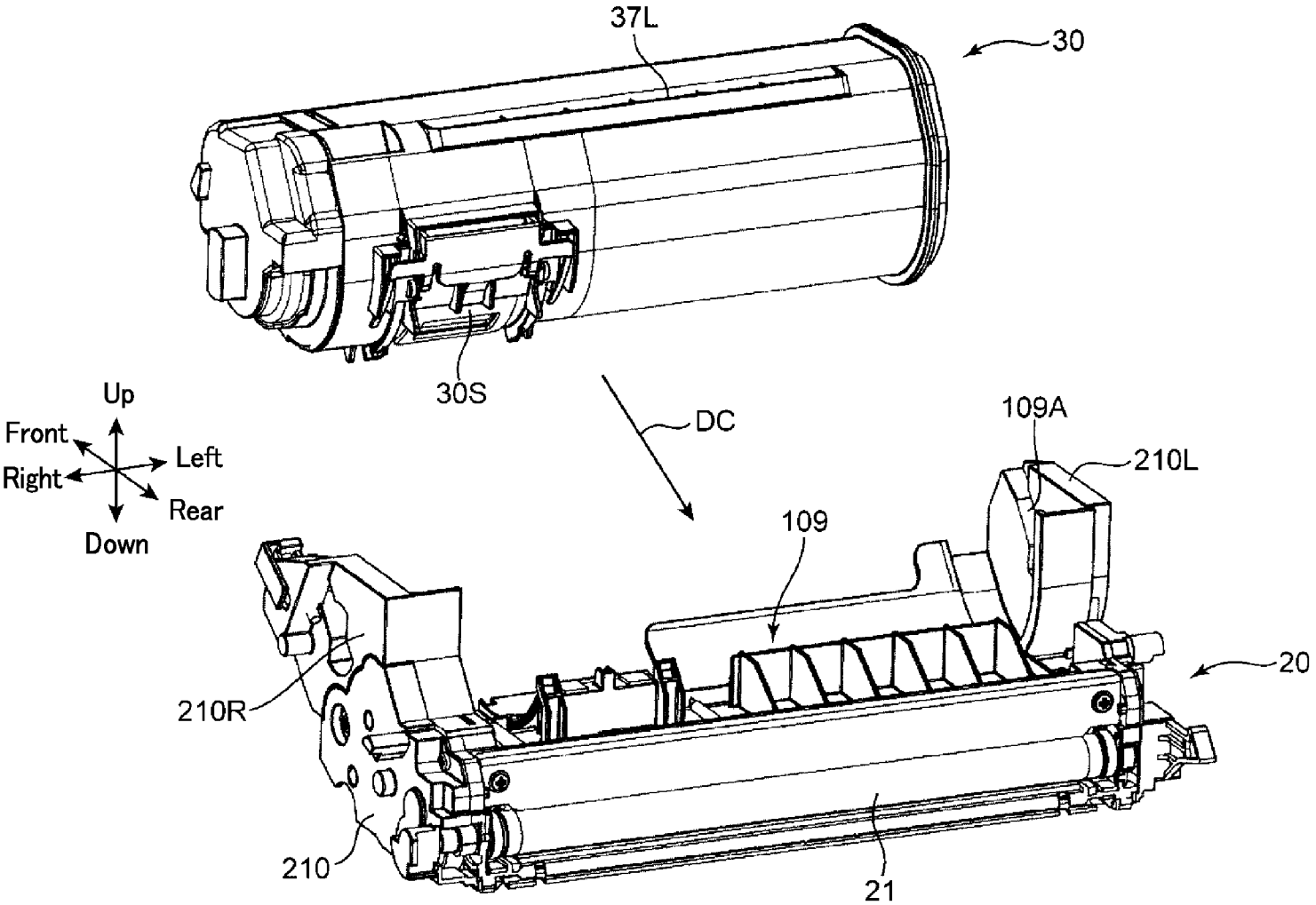
FIG. 6 is a perspective view illustrating a developer container and the developing device according to the embodiment of the present disclosure.
Figure 7:
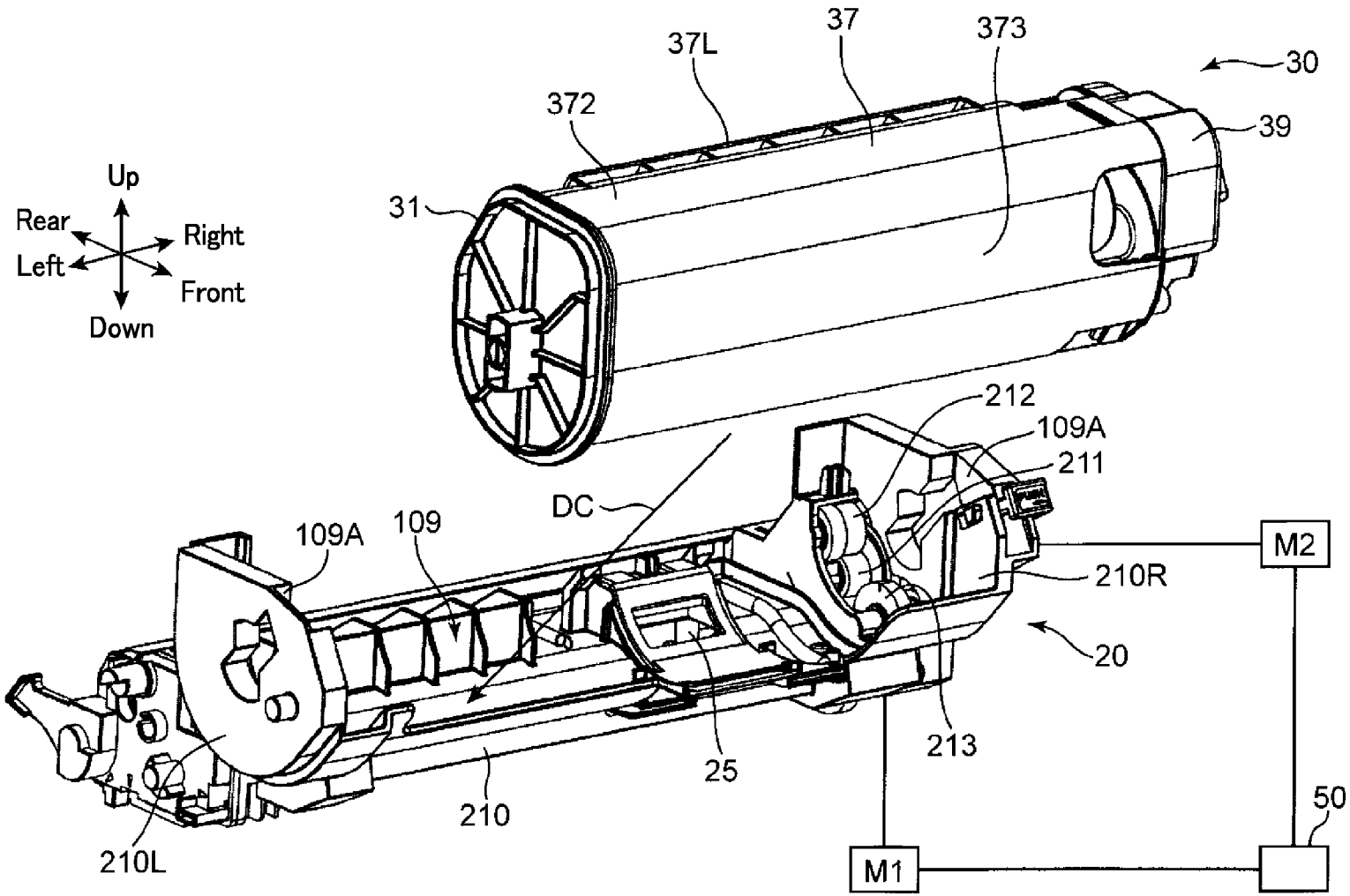
FIG. 7 is a perspective view illustrating the developer container and the developing device according to the embodiment of the present disclosure.

FIGS. 6 and 7 are perspective views illustrating the toner container 30 and the developing device 20 according to the present embodiment. The toner container 30 is attachable to and detachable from the developing device 20 in the casing 101. FIG. 2 illustrates that when the openable cover 100C of the casing 101 is in an open state, a container accommodating section 109 provided on the development housing 210 of the developing device 20 is externally exposed. As illustrated in FIGS. 6 and 7, the development housing 210 includes a left housing wall 210L and a right housing wall 210R that form a pair of housing walls. The container accommodating section 109 is formed between the left housing wall 210L and the right housing wall 210R. In the present embodiment, the toner container 30 is attached from roughly above the container accommodating section 109 (refer to arrow DC in FIGS. 6 and 7). When the toner container 30 is attached, a cover 39 of the toner container 30 is positioned at an end corresponding to the right housing wall 210R and a cap 31 of the toner container 30 is positioned at an end corresponding to the left housing wall 210L. The cover 39 and the cap 31 of the toner container 30 are explained further below. The development housing 210 includes a pair of guide grooves 109A (FIG. 7). The guide grooves 109A are grooves formed in the left housing wall 210L and the right housing wall 210R.

As illustrated in FIG. 7, the developing device 20 also includes a first transmission gear 211, a second transmission gear 212, and a third transmission gear 213. In addition, the printer 100 includes a first motor M1, a second motor M2, and a control section 50 in the casing 101. The first transmission gear 211, the second transmission gear 212, and the third transmission gear 213 are rotatably supported by the right housing wall 210R. The first transmission gear 211 is connected to the second transmission gear 212. The first transmission gear 211 is also connected to the development roller 21, the first stirring screw 23, and the second stirring screw 24 through a group of gears (not illustrated). When the developing device 20 is installed in the casing 101, the first motor M1 is connected to the third transmission gear 213 and the second motor M2 is connected to the first transmission gear 211.

The first motor M1 causes movement of a moveable wall 32 of the toner container 30 by causing rotation of a shaft 33 of the toner container 30 through the third transmission gear 213. The moveable wall 32 and the shaft 33 of the toner container 30 are explained further below. The second motor M2 causes rotation of the development roller 21, the first stirring screw 23, and the second stirring screw 24 of the developing device 20 through the first transmission gear 211. The second motor M2 also causes rotation of a stirring member 35 of the toner container 30, explained further below, through the first transmission gear 211 and the second transmission gear 212. The control section 50 drives various elements of the developing device 20 and the toner container 30 through control of the first motor M1 and the second motor M2, for example during a printing operation of the printer 100.

<Toner Container Structure>

Figure 8A:
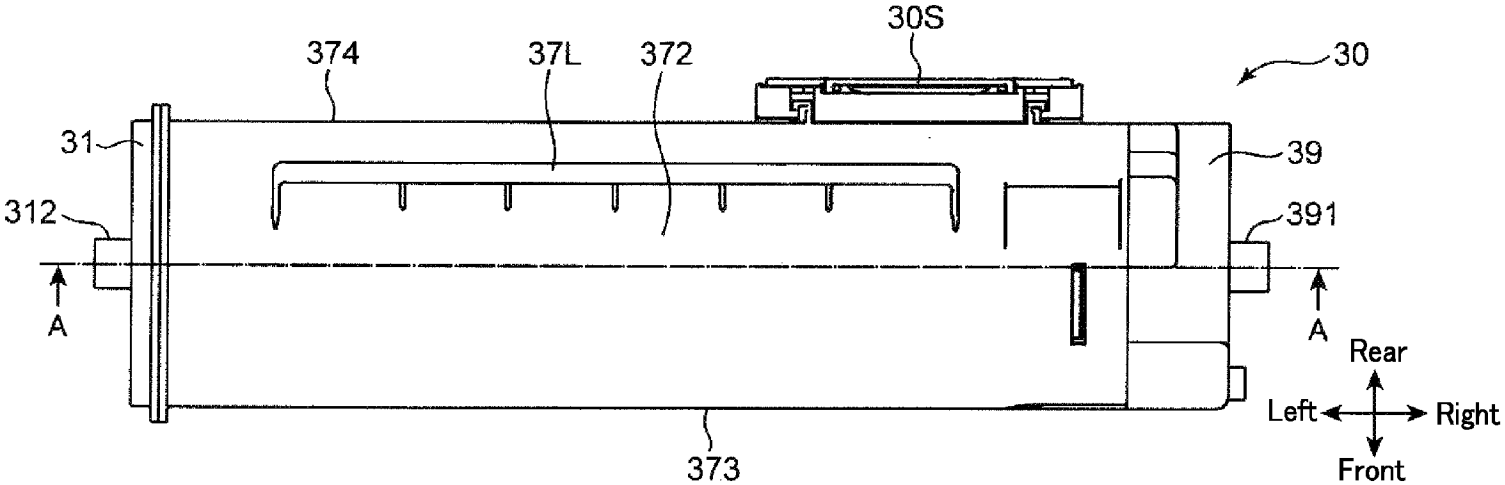
FIG. 8A is a plan view illustrating the developer container according to the embodiment of the present disclosure.
Figure 8B:
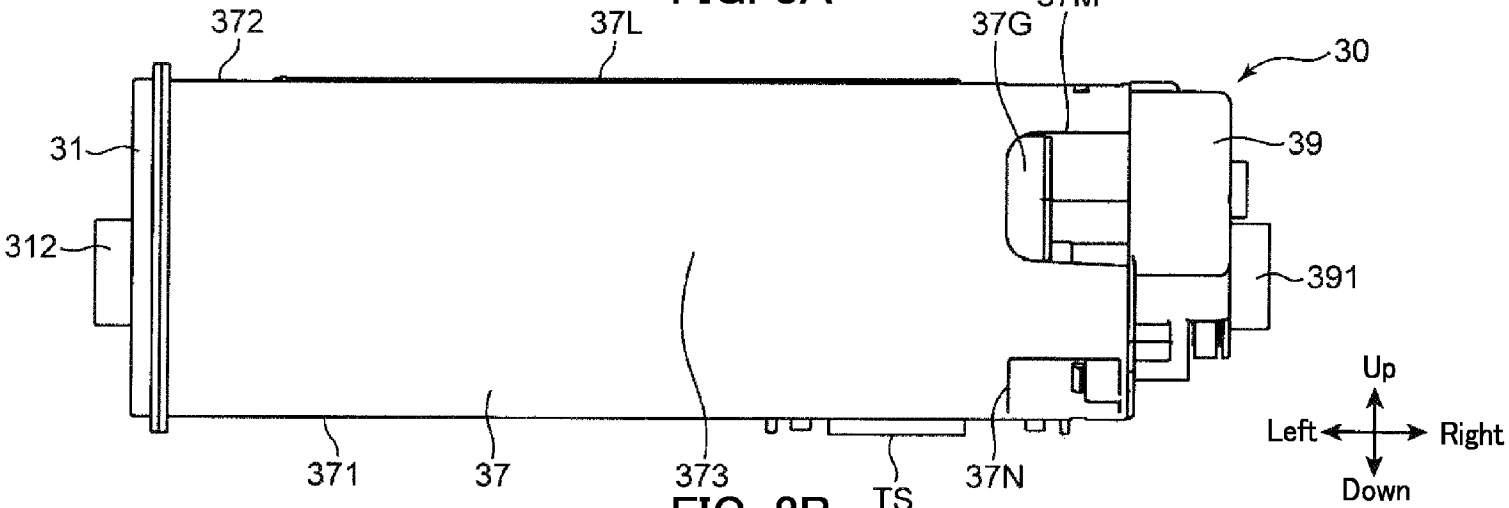
FIG. 8B is a front view illustrating the developer container according to the embodiment of the present disclosure.
Figure 9:
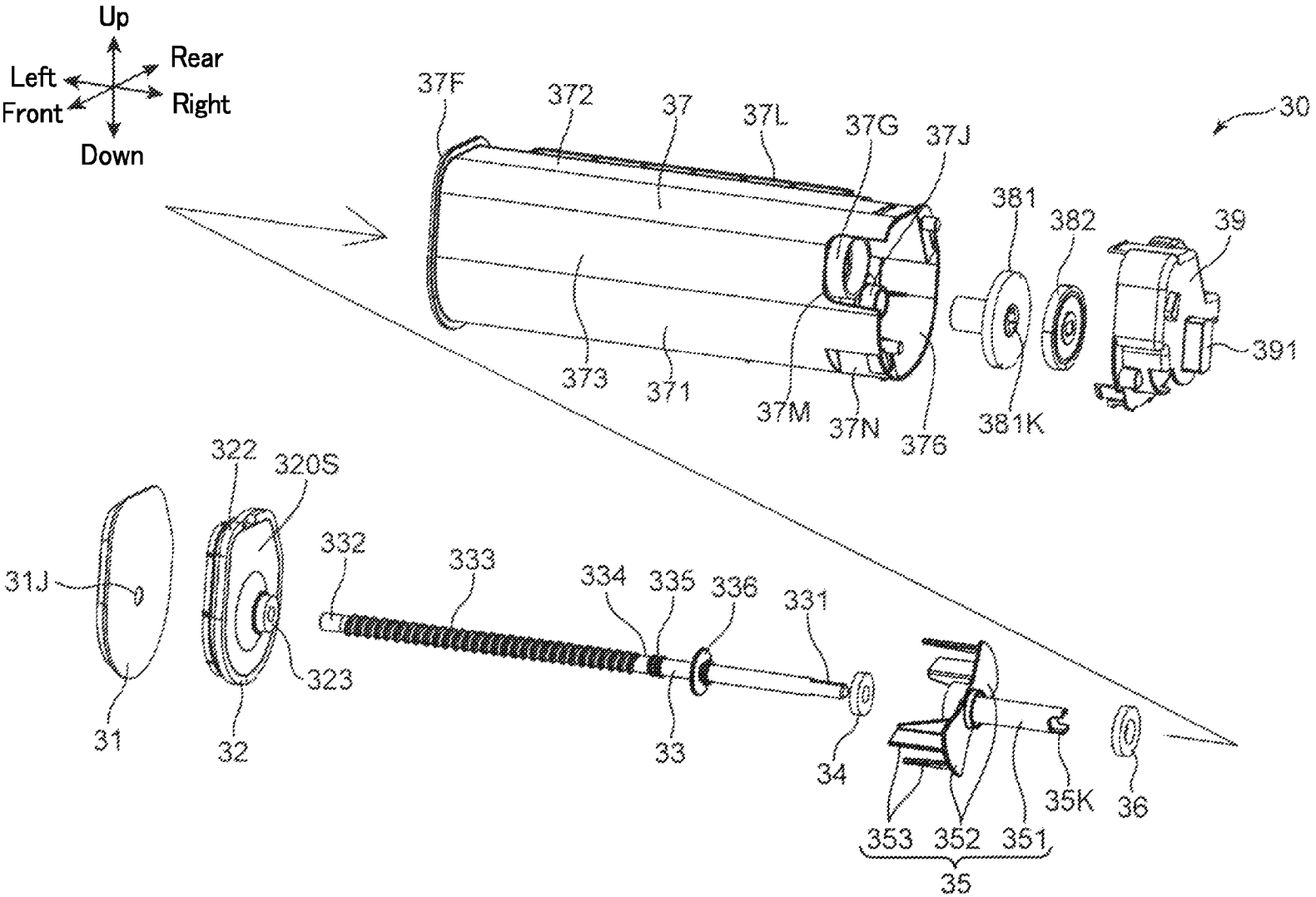
FIG. 9 is an exploded perspective view illustrating the developer container according to the embodiment of the present disclosure.
Figure 10:
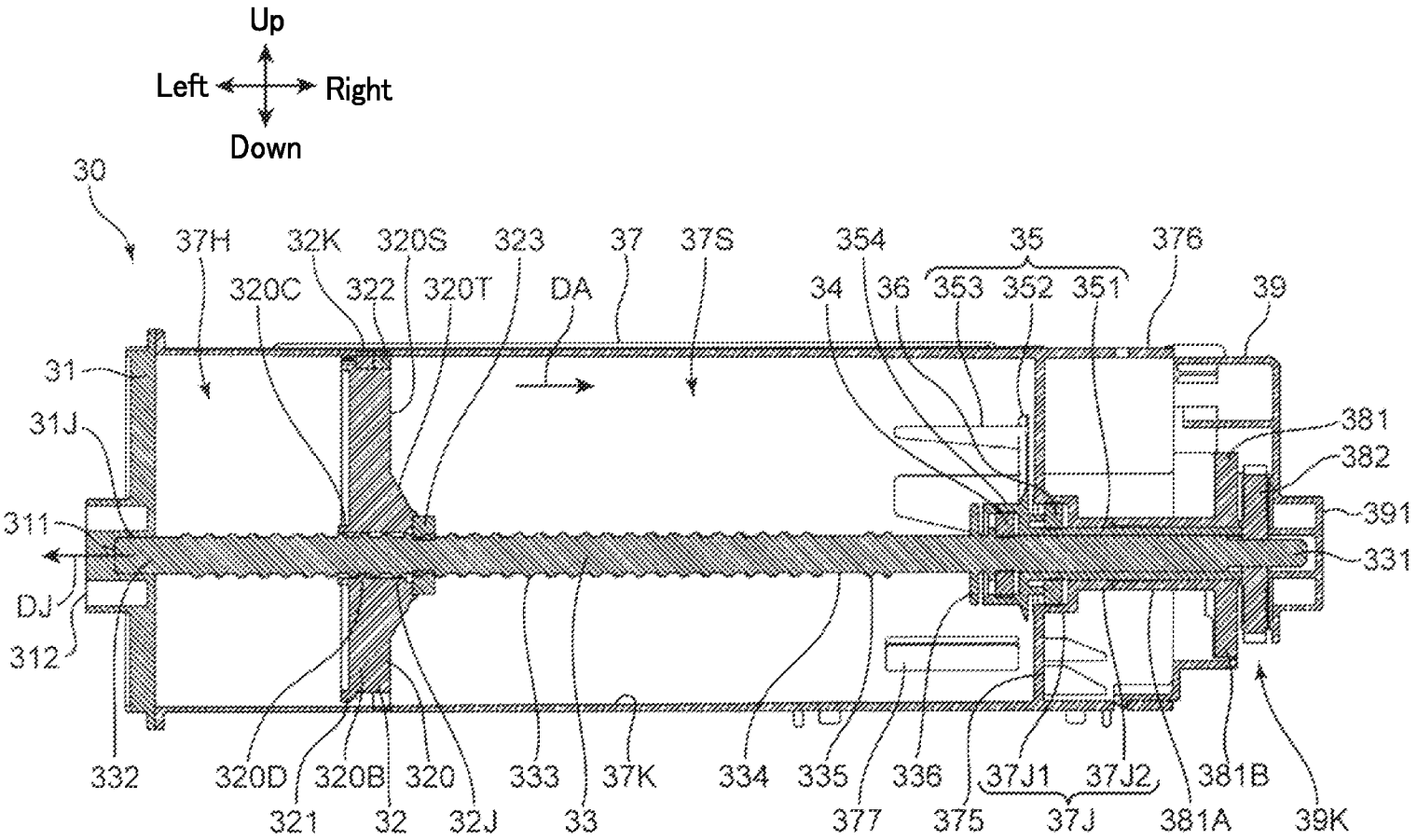
FIG. 10 is a cross-sectional view illustrating a moveable wall of the developer container according to the embodiment of the present disclosure.
Figure 11:
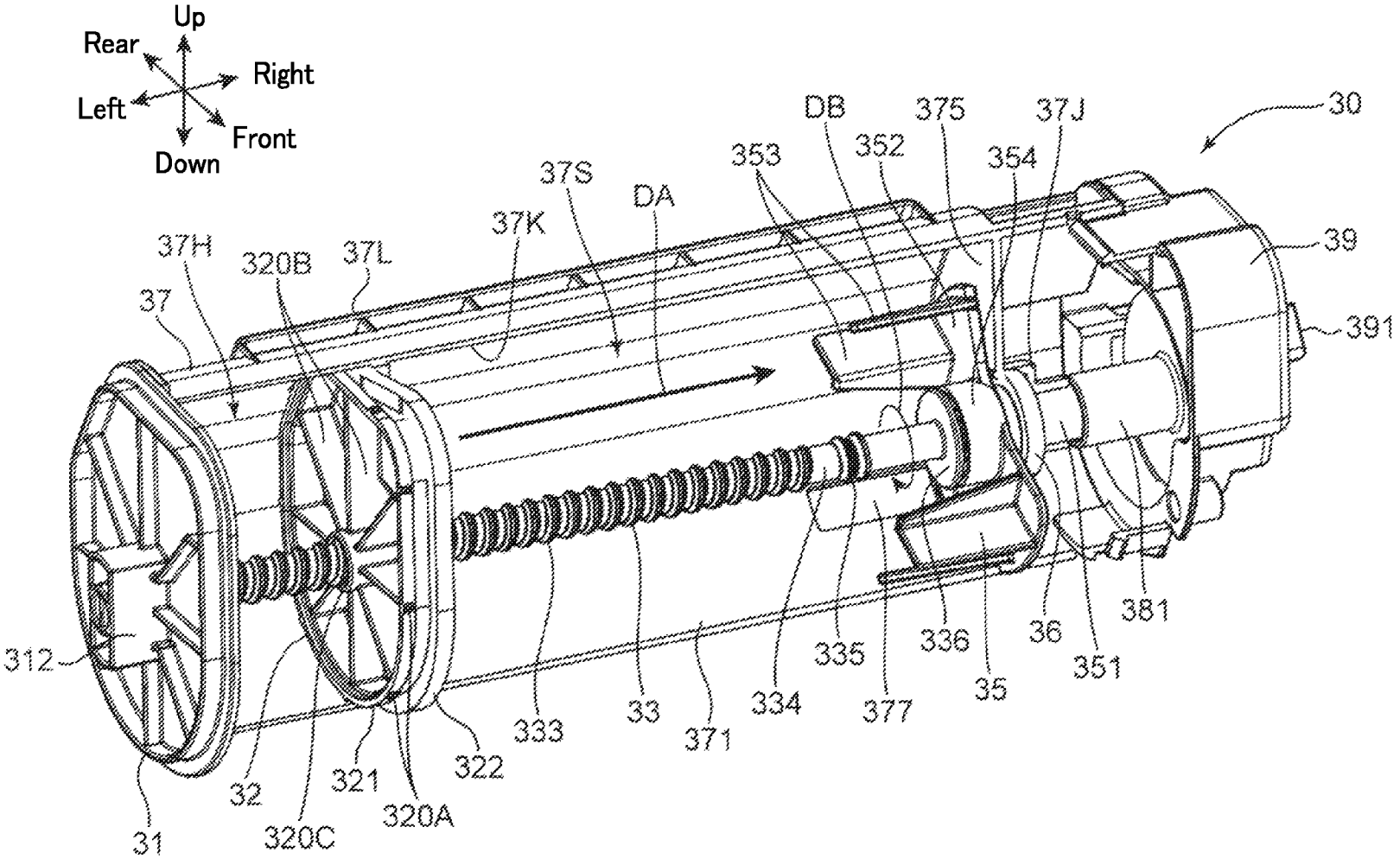
FIG. 11 is a perspective view illustrating internal appearance of the developer container according to the embodiment of the present disclosure.
Figure 12:
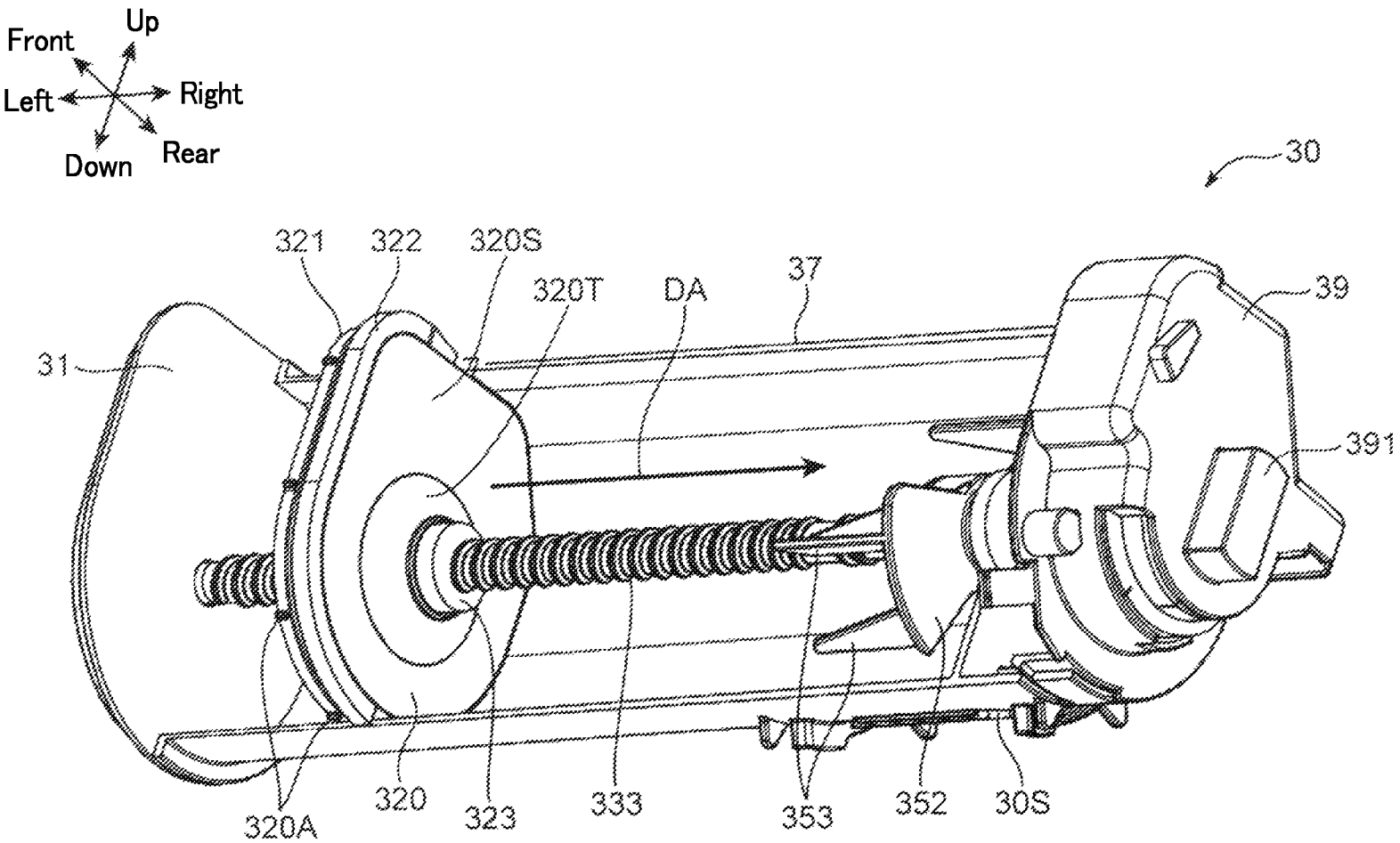
FIG. 12 is a perspective view illustrating internal appearance of the developer container according to the embodiment of the present disclosure.
Figure 13:
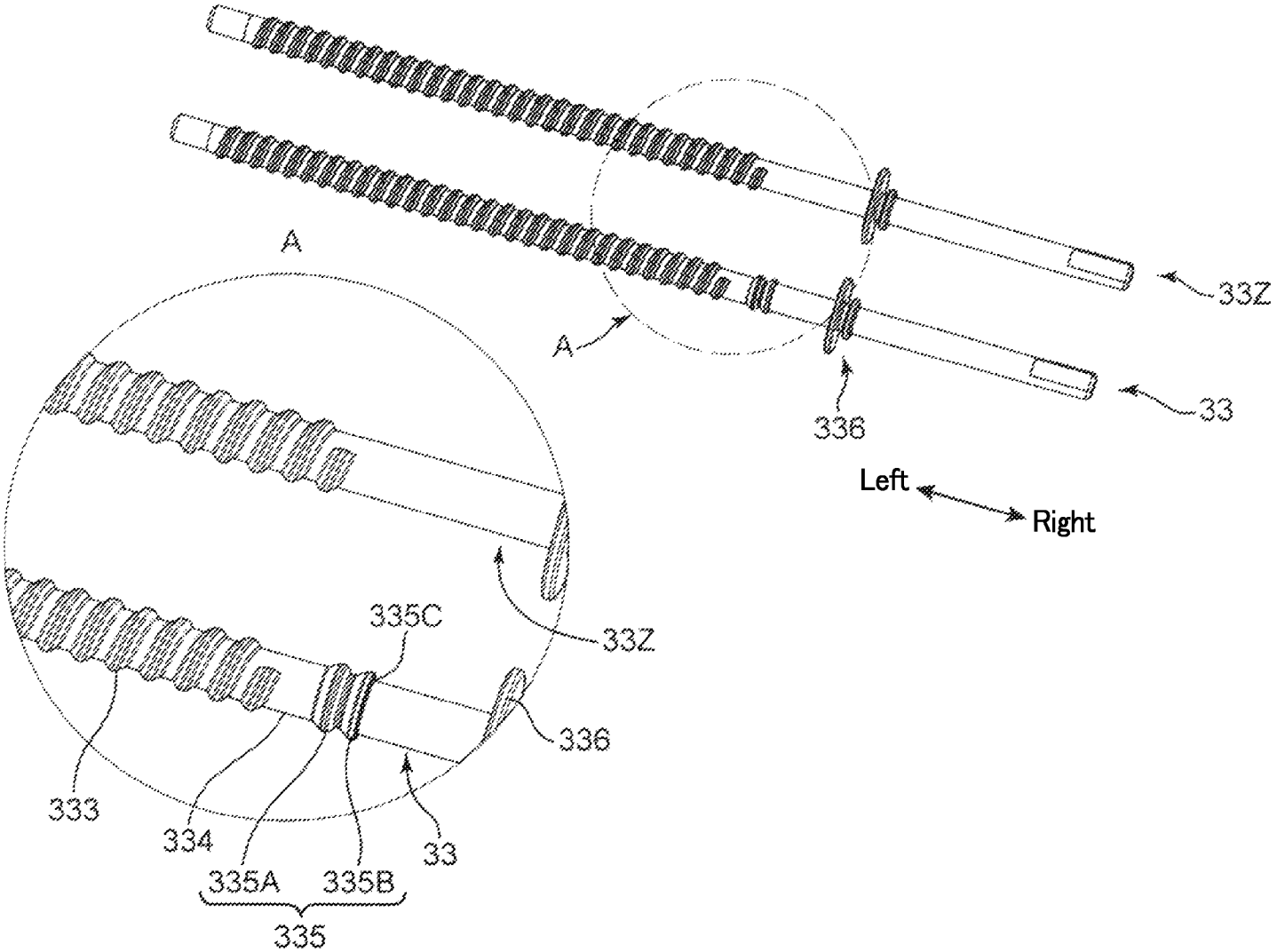
FIG. 13 is a perspective view illustrating a shaft of the developer container according to the embodiment of the present disclosure.
Figure 14:
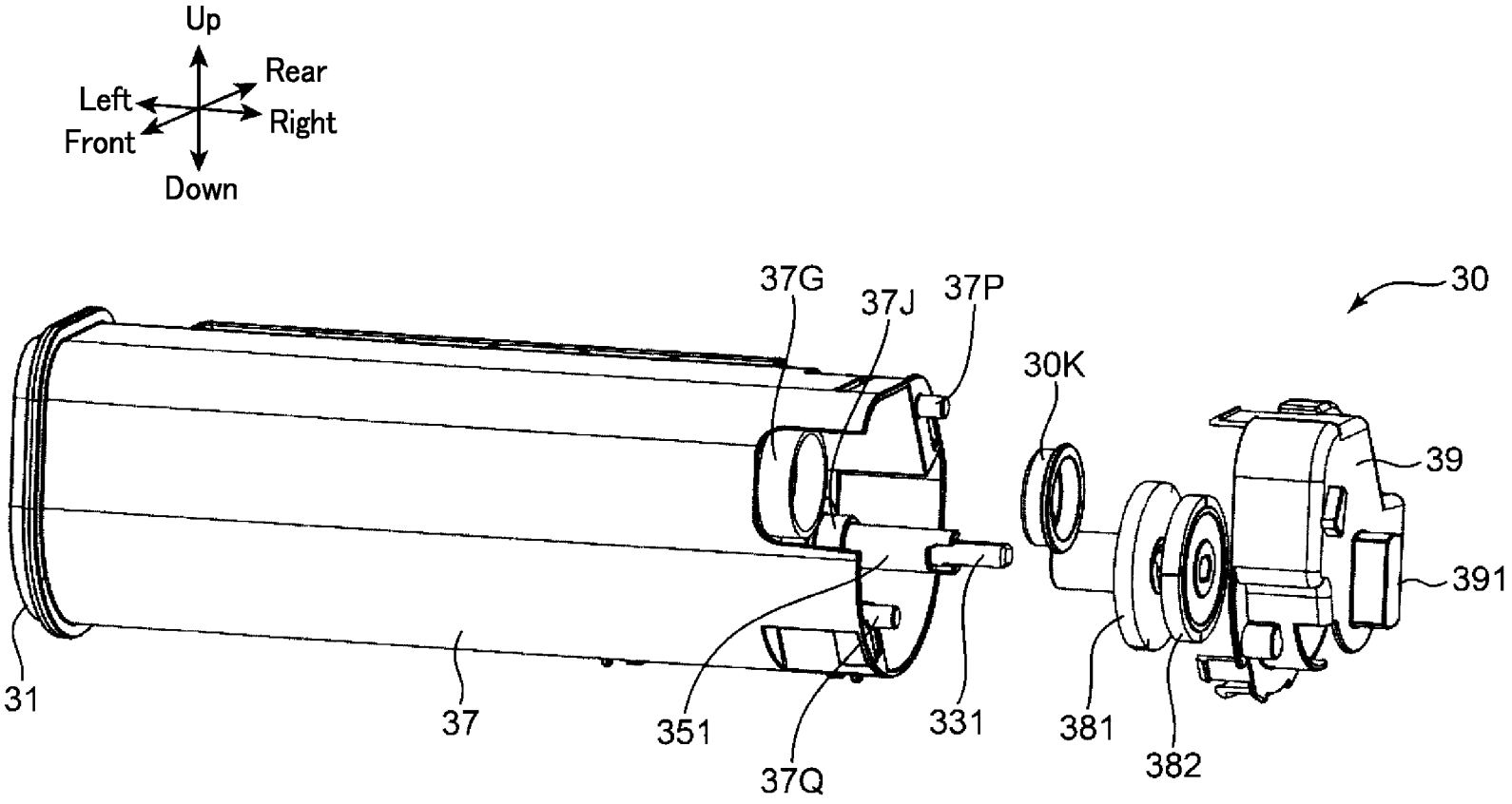
FIG. 14 is an exploded perspective view illustrating the developer container according to the embodiment of the present disclosure.
Figure 15B:
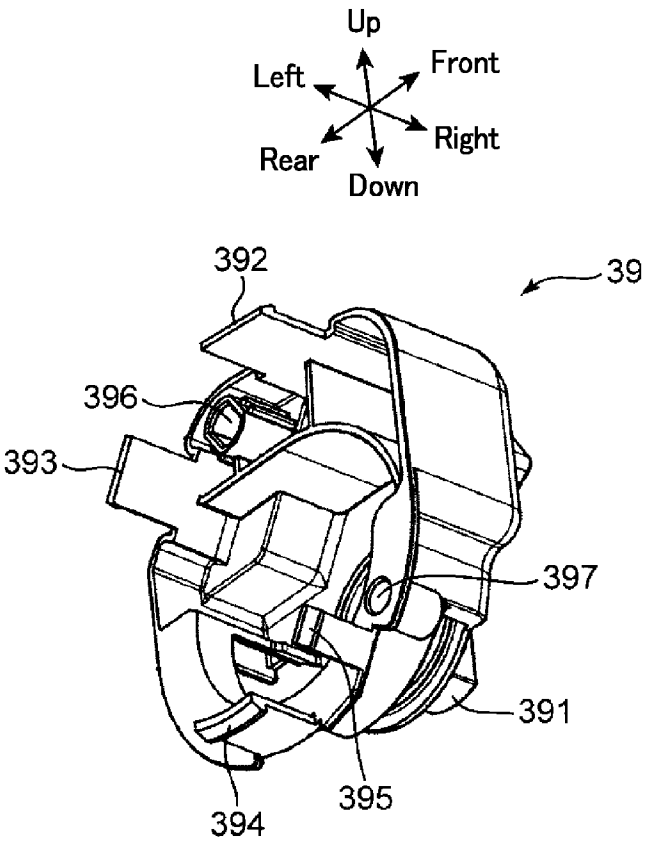
FIGS. 15A and 15B are perspective views illustrating a cover of the developer container according to the embodiment of the present disclosure.
Figure 15A:
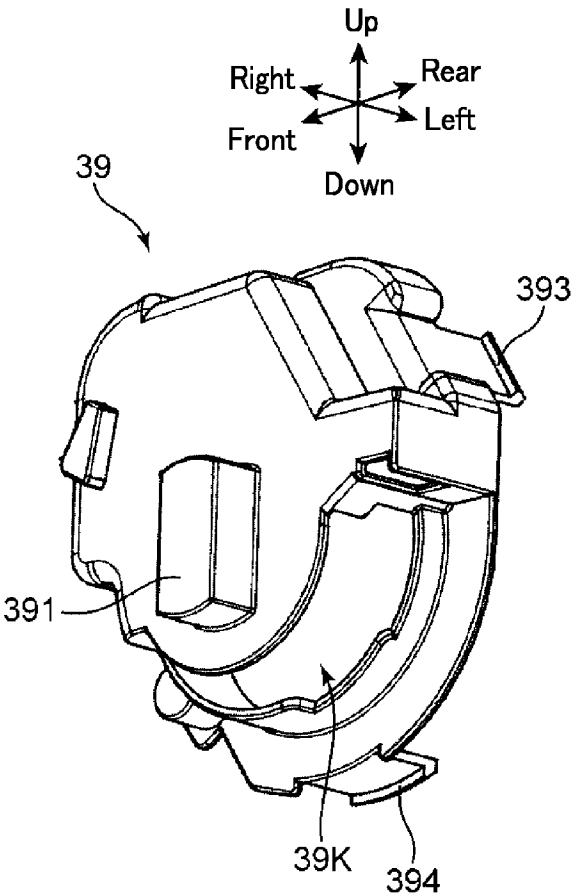
Figure 16A:
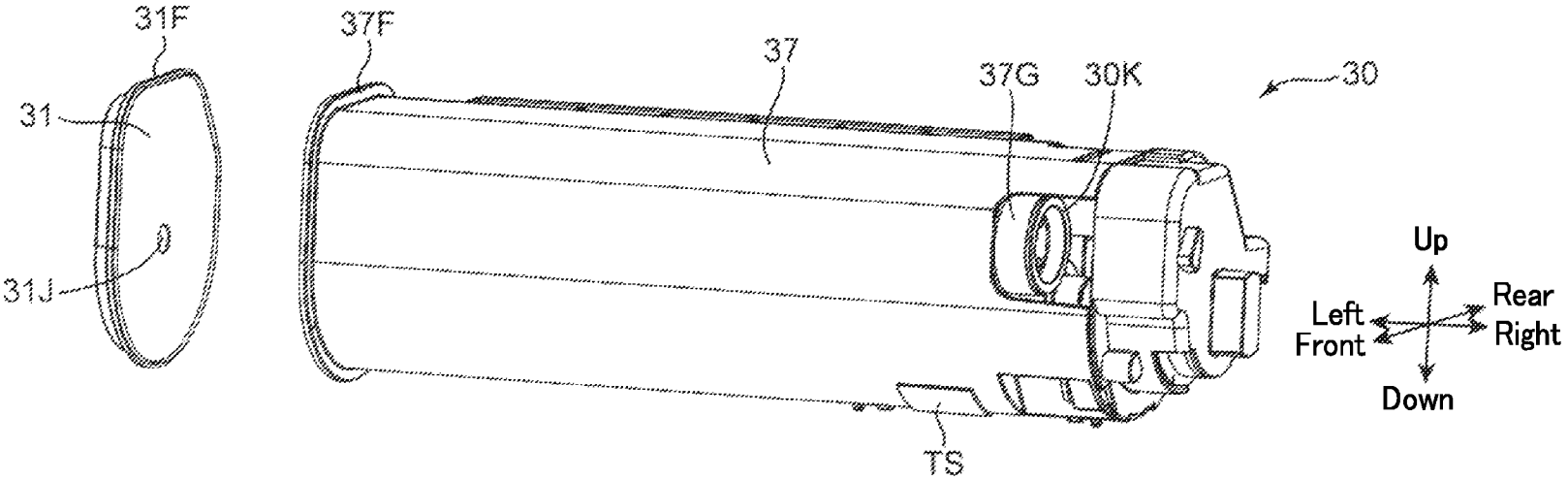
FIGS. 16A and 16B are exploded perspective views illustrating the developer container according to the embodiment of the present disclosure.
Figure 16B:
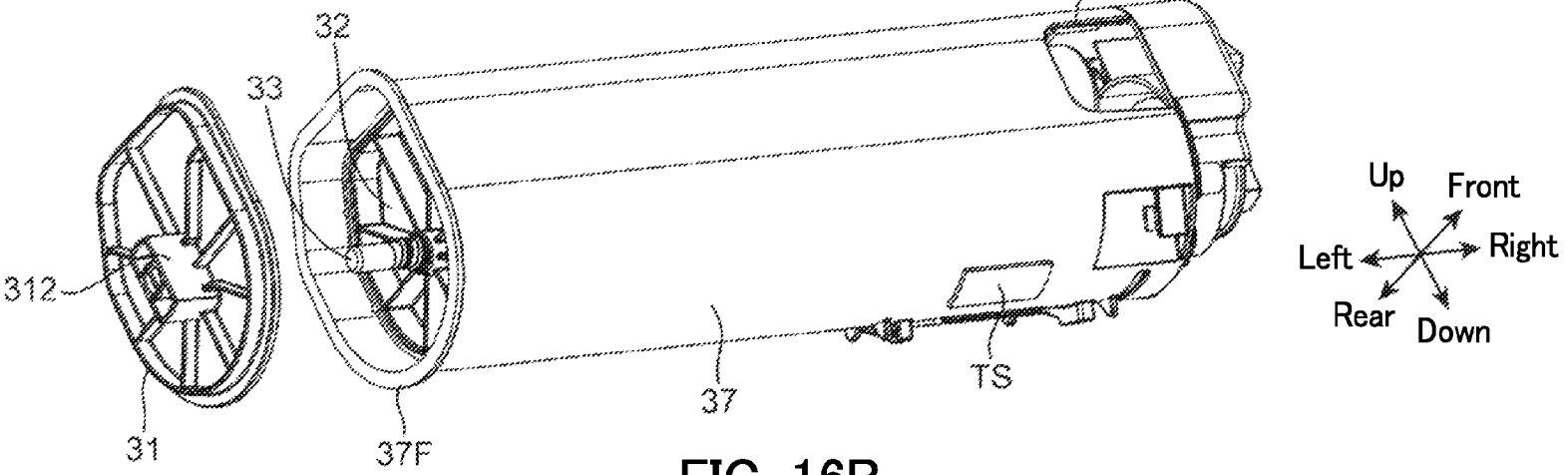

The following explains the toner container 30 (developer container) according to the embodiment of the present disclosure with reference to FIGS. 8A, 8B, and 9-12. FIG. 8A is a plan view illustrating the toner container 30 according to the present embodiment. FIG. 8B is a front view illustrating the toner container 30 according to the present embodiment. FIG. 9 is an exploded perspective view illustrating the toner container 30. FIG. 10 is a cross-sectional view at a position A-A indicated in FIG. 8A illustrating the toner container 30. FIGS. 11 and 12 are perspective views illustrating internal appearance of the toner container 30 according to the present embodiment. Note that FIGS. 11 and 12 are perspective views in which a container body 37 of the toner container 30, explained further below, is partially omitted. FIG. 13 is a perspective view illustrating the shaft 33 in the toner container 30. FIG. 14 is an exploded perspective view illustrating the toner container 30. FIGS. 15A and 15B are perspective views illustrating the cover 39 of the toner container 30. FIGS. 16A and 16B are exploded perspective views illustrating the toner container 30.

The toner container 30 has a tubular shape extending in the right/left direction (first direction, direction indicated by arrow DA in FIG. 10). The toner container 30 has an inner section containing replenishment toner (developer). As illustrated in FIG. 9, the toner container 30 includes the cap 31, the moveable wall 32, the shaft 33, a first seal 34, the stirring member 35, a second seal 36, the container body 37, a filling inlet cap 30K (FIG. 14), a toner sensor TS (FIGS. 16A and 16B), a first gear 381 (FIG. 9), a second gear 382 (drive transmission member), and the cover 39.

The cap 31 (FIGS. 9 and 10) is fixed to the container body 37. The cap 31 seals an opening of the container body 37. The cap 31 includes a cap shaft hole 31J, an abutment section 311, and a first guide section 312. The cap shaft hole 31J is provided in a central section of the cap 31. The cap shaft hole 31J supports the shaft 33 in a rotatable manner. The cap shaft hole 31J recesses for a specific length leftward from a side surface (inner surface) at a right-hand side of the cap 31. The abutment section 311 is equivalent to a surface at the bottom of the cap shaft hole 31J. An end surface of the shaft 33 abuts against the abutment section 311. The abutment section 311 has a function of limiting the position of the shaft 33 in a first direction. The first guide section 312 (FIG. 11) is a protrusion that protrudes from a side surface (outer surface) at a left-hand side of the cap 31 and extends in the up/down direction. The first guide section 312 has a function of guiding attachment of the toner container 30 to the developing device 20.

The container body 37 has a tubular shape and forms a body part of the toner container 30. The container body 37 includes an inner circumferential section 37K and an internal space 37H (FIGS. 10 and 11). The inner circumferential section 37K is an inner circumferential surface of the container body 37. The inner circumferential section 37K extends in a tubular shape in a longitudinal direction of the toner container 30 (first direction, direction indicated by arrow DA in FIGS. 10 and 11).

As illustrated in FIGS. 8A and 8B, the container body 37 includes the aforementioned bottom section 371, a top plate 372, a front wall 373, a rear wall 374, a right wall 375 (wall section) (FIG. 10), a body flange 37F (FIG. 9), and a protruding wall 376 (FIGS. 9 and 10). The bottom section 371 is a bottom part of the container body 37. The bottom section 371 has a semi-circular gutter shape that curves downward. In other words, in a cross-section intersecting the first direction, the bottom section 371 has an arc shape. The front wall 373 and the rear wall 374 are a pair of side walls that extend upward from side edges of the bottom section 371. The top plate 372 is located above the bottom section 371 and covers the internal space 37H from above. The right wall 375 is a wall section of the container body 37 that closes the container body 37. The right wall 375 is joined to one end in the first direction (right end) of the bottom section 371, the front wall 373, the rear wall 374, and the top plate 372. The internal space 37H is defined by the right wall 375, the cap 31, and the inner circumferential section 37K, which is formed by the bottom section 371, the top plate 372, the front wall 373, and the rear wall 374. The right wall 375 defines one end surface in the first direction of the internal space 37H. A region of the internal space 37H between the right wall 375 and the moveable wall 32 is referred to as a containment space 37S. The containment space 37S is a space in which toner is contained in the inner section the toner container 30.

As illustrated in FIG. 10, the container body 37 has an opening at an opposite end in the first direction to the right wall 375. The body flange 37F forms the aforementioned opening of the container body 37. The body flange 37F is a region at the left end of the container body 37 in which the external diameter of the container body 37 is slightly enlarged. The cap 31 is fixed to the body flange 37F such that the cap 31 closes the internal space 37H of the container body 37. A cap welding section 31F (FIG. 16A) that forms an outer circumferential edge of the cap 31 is ultrasonically welded (welded) to the body flange 37F.

As illustrated in FIGS. 9 and 10, the protruding wall 376 is a part of the outer circumferential section of the container body 37 that protrudes rightward beyond the right wall 375. The cover 39 is attached to the protruding wall 376.

As illustrated in FIGS. 8A and 8B, the container body 37 also includes the aforementioned toner discharge outlet 377 (developer discharge outlet), a shutter 30S, a holding section 37L, a front cutaway section 37M, a bottom cutaway section 37N, a filling inlet 37G, and a body bearing 37J (FIG. 10).

The toner discharge outlet 377 is provided in a bottom surface of the container body 37 so as to pass through the inner circumferential section 37K. As illustrated in FIGS. 10 and 11, the toner discharge outlet 377 is located at the right end (one end in the first direction) of the container body 37. In other words, the toner discharge outlet 377 is located in proximity to the right wall 375 in the first direction.

The toner discharge outlet 377 is a rectangular opening having a specific length in the first direction and having a specific width along the arc shape of the bottom section 371. The toner discharge outlet 377 in the present embodiment is located at a position that is shifted in a circumferential direction toward the rear relative to a lowermost part of the bottom section 371.

Toner contained in the containment space 37S is discharged toward the developing device 20 through the toner discharge outlet 377. As explained above, the bottom section 371, the front wall 373, the rear wall 374, and the top plate 372 form the internal space 37H of the container body 37 in the present embodiment. Therefore, toner within the containment space 37S collects in the arc shaped bottom section 371 under the toner's own weight and, as a result, toner conveyed by the moveable wall 32, explained further below, can be efficiently discharged through the toner discharge outlet 377.

The shutter 30S (FIG. 6) is located at the right end of the container body 37 in a slidable manner. The shutter 30S closes (seals) the toner discharge outlet 377 from outside of the container body 37 and can be moved to externally expose the toner discharge outlet 377. Sliding movement of the shutter 30S is linked to an operation of attaching the toner container 30 to the developing device 20.

The holding section 37L (FIG. 9) is a protrusion extending in the right/left direction that protrudes from a rear part of the top plate 372 of the container body 37. The holding section 37L can be held by a user. The front cutaway section 37M is a region in which part of a surface at the front of the protruding wall 376 is cut away leftward. The filling inlet 37G is exposed through the front cutaway section 37M. The bottom cutaway section 37N is a region in which part of a surface at the bottom of the protruding wall 376 recedes in an inward radial direction. The bottom cutaway section 37N engages with a fourth protruding plate 395 (FIG. 15B) of the cover 39 explained further below.

The filling inlet 37G extends rightward from the right wall 375 in a circular tubular shape. An inner tube section of the filling inlet 37G passes through the right wall 375 in the first direction. The filling inlet 37G connects the containment space 37S to outside of the container body 37. The containment space 37S is filled with toner through the filling inlet 37G during production of the toner container 30.

The body bearing 37J is formed in the right wall 375. The body bearing 37J protrudes rightward in a circular tubular shape from a central section of the right wall 375. As illustrated in FIG. 10, the body bearing 37J includes a large diameter section 37J1 and a small diameter section 37J2. The large diameter section 37J1 protrudes rightward in a circular tubular shape from the right wall 375. The small diameter section 37J2 is joined to a right end of the large diameter section 37J1. The small diameter section 37J2 is a circular tube having a smaller diameter than the large diameter section 37J1. The shaft 33 is inserted through the body bearing 37J. Once the shaft 33 has been inserted, a right end of the shaft 33 protrudes out of the container body 37. One part (stirrer bearing 351) of the stirring member 35 is inserted between the body bearing 37J and the shaft 33 in the inner tube section of the body bearing 37J.

The filling inlet cap 30K (FIG. 14) is attached into the filling inlet 37G of the container body 37 such as to seal the filling inlet 37G. The filling inlet cap 30K is attached and welded into the filling inlet 37G after the containment space 37S has been filled with toner through the filling inlet 37G. As a result, leakage of the toner through the filling inlet 37G is prevented.

The moveable wall 32 is a wall section in the inner section (internal space 37H) of the container body 37 that faces in the first direction. The moveable wall 32 defines one end surface in the first direction (left end surface) of the containment space 37S. Note that the other end surface in the first direction (right end surface) of the containment space 37S is defined by the right wall 375. The moveable wall 32 has a function of moving in the first direction in the internal space 37H from an initial position at one side of the internal space 37H to a final position at another side of the internal space 37H while conveying toner in the containment space 37S toward the toner discharge outlet 377, during a period between the start and end of use of the toner container 30. In the present embodiment, the initial position of the moveable wall 32 is to the right (downstream in the first direction) of the cap 31 and the final position of the moveable wall 32 is directly to the left (upstream in the first direction) of the toner discharge outlet 377. The moveable wall 32 is moved using rotational driving force generated by the first motor M1. The cap 31 is located further upstream in the first direction than the moveable wall 32. The right wall 375 is located further downstream in the first direction than the moveable wall 32.

As illustrated in FIGS. 10-12, the moveable wall 32 includes a conveying wall section 320, an outer circumferential wall section 321, guide ribs 320A (FIG. 12), inner ribs 320B (FIG. 11), a circular tube section 320C, an inner wall seal 322 (inner wall elastic member), a shaft seal 323 (shaft elastic member), a bearing 32J (FIG. 10), and an outer circumferential section 32K.

The conveying wall section 320 defines the containment space 37S in conjunction with the inner circumferential section 37K of the container body 37. More specifically, the conveying wall section 320 includes a conveying surface 320S that is perpendicular to the shaft 33. The conveying surface 320S pushes and conveys toner in the containment space 37S in accompaniment to movement of the moveable wall 32. The conveying surface 320S in the present embodiment includes a tapered surface 320T (FIGS. 10 and 12). The tapered surface 320T is shaped such as to surround the periphery of the shaft 33. Part of the conveying surface 320S is inclined downstream in the first direction.

The bearing 32J is formed in roughly a central section of the conveying wall section 320. The bearing 32J holds the moveable wall 32 while moving in the first direction. The shaft 33, explained further below, is inserted through the bearing 32J.

The circular tube section 320C protrudes upstream in the first direction from a surface on the opposite side of the conveying wall section 320 to the conveying surface 320S. The circular tube section 320C forms part of the bearing 32J. The circular tube section 320C includes an internal thread 320D. The internal thread 320D is a helical screw section formed on an inner circumferential surface of the circular tube section 320C. The internal thread 320D has a function of moving the moveable wall 32 in the first direction by engaging with an external thread 333 of the shaft 33 explained further below. During movement of the moveable wall 32, the orientation of the moveable wall 32 is maintained by contact between an inner wall of the circular tube section 320C and an outer circumferential section of the shaft 33. Such a configuration restricts the conveying wall section 320 of the moveable wall 32 from tilting relative to the shaft 33.

The outer circumferential wall section 321 extends in an opposite direction to the containment space 37S—in other words, upstream in a movement direction of the moveable wall 32 (upstream in the first direction)—from along the entire outer circumferential edge of the conveying wall section 320. The outer circumferential wall section 321 is located opposite to the inner circumferential section 37K of the container body 37. The guide ribs 320A are rib members that extend in the first direction along the outer circumferential wall section 321. The guide ribs 320A are located along the circumferential surface of the outer circumferential wall section 321 at intervals in a circumferential direction in which the shaft 33 rotates. The guide ribs 320A are in faint contact with the inner circumferential section 37K of the container body 37 and have a function of restricting the moveable wall 32 from tilting in the container body 37 relative to the shaft 33.

As illustrated in FIG. 11, the inner ribs 320B connect the outer circumferential surface of the circular tube section 320C to the inner circumferential surface of the outer circumferential wall section 321. The inner ribs 320B are arranged in the circumferential direction. Note that as FIG. 10 is a cross-section in the up/down direction, passing through an axial center of the shaft 33, some of the inner ribs 320B and the conveying wall section 320 are illustrated in a connected state.

The inner wall seal 322 is a sealing member that is located at a side of the outer circumferential wall section 321 corresponding to the conveying wall section 320 such as to cover a periphery of the conveying wall section 320. The inner wall seal 322 is an elastic member formed from urethane sponge. After fixing one end of the tape-shaped inner wall seal 322 to an upper part of the conveying wall section 320, the inner wall seal 322 is wound around and fixed to the conveying wall section 320. The other end of the inner wall seal 322 is fixed such as to overlap with the one end of the inner wall seal 322. The inner wall seal 322 is subjected to compression deformation between the moveable wall 32 and the inner circumferential section 37K of the container body 37. In addition, the inner wall seal 322 is formed along the outer circumferential section 32K of the moveable wall 32. The outer circumferential section 32K is in sealed contact with the inner circumferential section 37K of the container body 37. The inner wall seal 322 prevents toner in the containment space 37S from flowing upstream in the movement direction of the moveable wall 32 by passing between the moveable wall 32 and the inner circumferential section 37K of the container body 37. The guide ribs 320A described above are located further upstream in the first direction than the inner wall seal 322.

The shaft seal 323 is fixed to the bearing 32J at a position further downstream in the movement direction of the moveable wall 32 than the internal thread 320D (FIG. 11). More specifically, the shaft seal 323 in the present embodiment is located at a tip of the tapered surface 320T of the conveying surface 320S. The shaft seal 323 is an elastic member formed from urethane sponge. The shaft seal 323 is in contact with the external thread 333 of the shaft 33 as the moveable wall 32 moves. During movement of the moveable wall 32, a given part of the external thread 333 comes into contact with the shaft seal 323 before coming into contact with the internal thread 320D and adhered toner is cleaned off the external thread 333 by the shaft seal 323. Therefore, the external thread 333 engages with the internal thread 320D in a substantially toner-free state. As a consequence, agglomeration of toner between the external thread 333 and the internal thread 320D can be inhibited and steady movement of the moveable wall 32 can be achieved. The shaft seal 323 is ring shaped and, as a result, is in sealed contact with the shaft 33 around the entire circumference of the shaft 33. Therefore, toner in the containment space 37S is prevented from flowing through the bearing 32J to upstream of the moveable wall 32 in the movement direction.

The shaft 33 is supported in a rotatable manner by the cap 31 and the right wall 375 of the container body 37 such as to extend through the internal space 37H in the first direction. The shaft 33 includes a first shaft end 331, a second shaft end 332, the aforementioned external thread 333, a moveable wall stopping section 334, a moveable wall support section 335 (tilt restricting mechanism, protrusion), and shaft flanges 336.

As illustrated in FIGS. 9 and 10, the first shaft end 331 is a right end of the shaft 33 (one end in the first direction). The first shaft end 331 is a tip of the shaft 33 that extends through the body bearing 37J and protrudes rightward from the body bearing 37J. The circumferential surface at the first shaft end 331 has a double D shape as illustrated in FIG. 9. The first shaft end 331 engages with the second gear 382, which has a D hole in a central section thereof. As a result of the above configuration, the shaft 33 and the second gear 382 are rotatable integrally with one another. The tip of the first shaft end 331 that is inserted through the second gear 382 protrudes into a second guide section 391 of the cover 39 explained further below. The second shaft end 332 is a left end of the shaft 33 (other end in the first direction). The second shaft end 332 is axially supported by the cap shaft hole 31J in the cap 31.

The external thread 333 is a helical screw section located on the outer circumferential surface of the shaft 33 in the internal space 37H. As illustrated in FIG. 10, the external thread 333 in the present embodiment extends from a region of the shaft 33 in proximity to the cap 31 to a region of the shaft 33 that is further upstream in the first direction (arrow DA in FIG. 10) than the toner discharge outlet 377.

The moveable wall stopping section 334 is directly adjacent to a downstream end in the first direction of the external thread 333. The moveable wall stopping section 334 is a region of the shaft 33 in the internal space 37H in which the external thread 333 is not present; in other words, a region in which only an axial part of the shaft 33 is present. The moveable wall stopping section 334 is located above the toner discharge outlet 377 at a position further upstream in the first direction than the toner discharge outlet 377.

The moveable wall support section 335 is located downstream in the first direction of the moveable wall stopping section 334. In other words, the external thread 333 and the moveable wall support section 335 are not directly adjacent in the first direction. The moveable wall support section 335 includes protrusions that protrude radially from the circumferential surface of the shaft 33. As illustrated in FIG. 10, the moveable wall support section 335 is located above an upstream end in the first direction of the toner discharge outlet 377. FIG. 13 illustrates a perspective view and an enlarged perspective view of the shaft 33 and a shaft 33Z. In contrast to the shaft 33 according to the present embodiment, the shaft 33Z does not include a moveable wall support section 335. The shaft 33Z is explained further below in an alternative embodiment.

The moveable wall support section 335 has a function of restricting the conveying surface 320S of the moveable wall 32 from tilting relative to the first direction (i.e., relative to the shaft 33) when the moveable wall 32 has reached the final position. The protrusions of the moveable wall support section 335 each have a ring shape that extends in the circumferential direction along the circumferential surface of the shaft 33. The moveable wall support section 335 in the present embodiment includes a plurality of protrusions (i.e., two) arranged in the first direction. More specifically, the moveable wall support section 335 includes a first support section 335A (protrusion) and a second support section 335B (protrusion) (FIG. 13). The first support section 335A and the second support section 335B are both ring shaped protrusions. The second support section 335B is located downstream in the first direction of the first support section 335A. As illustrated by the enlarged view in FIG. 13, the first support section 335A has inclined surfaces that incline radially inward from a central ridge that is approximately centrally positioned in the first direction in the first support section 335A. One of the inclined surfaces is inclined from the central ridge in an upstream direction and the other of the inclined surfaces is inclined from the central ridge in a downstream direction. The second support section 335B has an inclined surface that is inclined radially outward in the downstream direction and a side surface 335C that is adjacent to the inclined surface. The side surface 335C is at a downstream side in the first direction and is oriented perpendicularly to the first direction.

In terms of the height by which the first support section 335A and the second support section 335B protrude from the circumferential surface of the shaft 33, the height may be the same as the height of crests of the external thread 333 or may be slightly higher than the height of the crests of the external thread 333.

The shaft flanges 336 are located further downstream in the first direction than the moveable wall support section 335 with an interval therebetween. The shaft flanges 336 are circular plate-shaped flanges that protrude in a radial direction from the circumferential surface of the shaft 33. As illustrated in FIGS. 9, 10, and 13, two shaft flanges 336 are located adjacently to one another in the first direction. A downstream one of the shaft flanges 336 in the first direction has a smaller diameter than an upstream one of the shaft flanges 336 in the first direction. The downstream shaft flange 336 has a function of compressing the first seal 34 (FIG. 10) in conjunction with a stirrer circular tube section 354 (FIG. 11) of the stirring member 35 explained further below. The upstream shaft flange 336 has a function of inhibiting toner from leaking into the stirrer circular tube section 354.

As explained above, the first seal 34 is a ring shaped sealing member that is compressed between one of the shaft flanges 336 of the shaft 33 and a side surface of the stirrer circular tube section 354 of the stirring member 35. The first seal 34 is formed from a spongy material. The first seal 34 fits between the inner circumferential surface of the stirrer bearing 351 (FIG. 10) of the stirring member 35 and the circumferential surface of the shaft 33 in order to prevent toner from leaking out of the container body 37.

The stirring member 35 (FIGS. 9 and 10) is located along the right wall 375, above the toner discharge outlet 377. The stirring member 35 stirs toner in the containment space 37S. The stirring member 35 in the present embodiment rotates around and relative to the shaft 33. The stirring member 35 rotates in a direction indicated by arrow DB in FIG. 11. The stirring member 35 includes the aforementioned stirrer bearing 351, stirrer support sections 352 (support sections), stirring blades 353 (blade sections), and the aforementioned stirrer circular tube section 354 (FIGS. 10 and 11).

The stirrer bearing 351 has a circular tubular shape that is fitted externally to the shaft 33. The stirrer bearing 351 protrudes through the body bearing 37J from the containment space 37S of the container body 37. As a result, a right end of the stirrer bearing 351 passes through the body bearing 37J and is exposed to outside of the container body 37 beyond the right wall 375 (body bearing 37J) (refer to FIG. 14). In contrast, a left end of the stirrer bearing 351 is located in the containment space 37S. A first engaging section 35K is located at the right end of the stirrer bearing 351 (FIG. 9). The first engaging section 35K engages with a second engaging section 381K located on an inner circumferential surface of the first gear 381. As a result of the above configuration, the stirring member 35 and the first gear 381 are rotatable integrally with one another.

The stirrer support sections 352 are protruding plates that protrude in a radial direction of the shaft 33 from the left end of the tubular stirrer bearing 351. The stirrer support sections 352 extend along the right wall 375 and face in the first direction. The stirrer support sections 352 rotate around the shaft 33 in the containment space 37S. More specifically, a pair of the stirrer support sections 352 is provided in the present embodiment. One of the stirrer support sections 352 extends radially outward from the shaft 33 along the right wall 375. The other of the stirrer support sections 352 extends radially outward from the shaft 33 at a different position in the circumferential direction to the one stirrer support section 352. In other words, the pair of stirrer support sections 352 extend in opposite radial directions relative to one another. The pair of stirrer support sections 352 has a propeller-like shape that widens in the circumferential direction as the stirrer support sections 352 extend radially outward. Compared to a configuration in which a circular plate-shaped stirrer support section 352 is provided, the above configuration prevents agglomeration of toner in a gap between the stirrer support section 352 and the right wall 375 due to the toner in the gap being more mobile.

The stirring blades 353 are blade members that protrude leftward (upstream in the first direction) from the pair of stirrer support sections 352. As illustrated in FIGS. 11 and 12, two stirring blades 353 protrude from each of the stirrer support sections 352. Each of the stirring blades 353 is L-shaped in a cross-section perpendicular to the axial direction of the shaft 33 (refer to FIG. 17B). The stirring blades 353 circulate above the toner discharge outlet 377, thereby stirring toner in the vicinity of the toner discharge outlet 377 and discharging toner through the toner discharge outlet 377.

The stirrer circular tube section 354 is a region of the stirrer bearing 351 that is located leftward of the stirrer support section 352. An external diameter of the stirrer circular tube section 354 is larger than an external diameter of a region of the stirrer bearing 351 that is located rightward of the stirrer support section 352. The first seal 34 is compressed within the stirrer circular tube section 354 as illustrated in FIG. 10.

The second seal 36 is a ring shaped sealing member that is located within the large diameter section 37J1 of the body bearing 37J. The second seal 36 is compressed between a ring shaped protrusion on a right surface of the stirrer support section 352 of the stirring member 35 and a step section between the large diameter section 37J1 and the small diameter section 37J2 of the body bearing 37J. The second seal 36 is made from a spongy material. The second seal 36 is fitted between the outer circumferential surface of the stirrer bearing 351 of the stirring member 35 and the inner circumferential surface of the body bearing 37J such as to prevent leakage of toner to outside of the container body 37.

The first gear 381 transmits rotational driving force to the stirring member 35. The first gear 381 is connected to the second motor M2 through the first transmission gear 211 and the second transmission gear 212 (FIG. 7). The first gear 381 is connected to the stirrer bearing 351 of the stirring member 35, which is inserted through the body bearing 37J. The first gear 381 includes a gear circular tube section 381A having a circular tubular shape and a first gear wheel 381B (FIG. 10).

The gear circular tube section 381A is fitted externally onto the stirrer bearing 351 of the stirring member 35. As explained above, the first engaging section 35K (FIG. 9) of the stirring member 35 is connected to the second engaging section 381K of the first gear 381 and, as a result, the gear circular tube section 381A is connected to the stirrer bearing 351. Through the above configuration, the first gear 381 and the stirring member 35 are rotatable integrally with one another.

The first gear wheel 381B is a gear located at a right end of the gear circular tube section 381A. The first gear wheel 381B has a larger outer circumference than the gear circular tube section 381A. The first gear wheel 381B has gear teeth on a circumferential surface thereof.

The second gear 382 transmits rotational driving force to the shaft 33. The second gear 382 has gear teeth on a circumferential surface thereof. The second gear 382 is connected to the first motor M1 through the third transmission gear 213 (FIG. 7). As illustrated in FIG. 10, the right end of the shaft 33 is inserted through the stirrer bearing 351 of the stirring member 35. The second gear 382 is connected (fixed) to the tip (first shaft end 331) of the shaft 33 inserted through the stirrer bearing 351. As illustrated in FIG. 10, a side surface of the second gear 382 is located opposite to the tip of the stirrer bearing 351 of the stirring member 35. The second gear 382 is adjacent to the first gear wheel 381B in the first direction. The first gear 381 and the second gear 382 are located downstream in the movement direction of the moveable wall 32 (first direction).

In other words, as illustrated in FIG. 10, the first gear 381 and the second gear 382 are located together outside of the container body 37 at a position opposite to the right wall 375 of the container body 37. Therefore, the toner container 30 as a whole can be configured compactly, particularly in the first direction. In addition, the need to provide shaft holes through both the cap 31 and the right wall 375 can be reduced. Therefore, toner (developer) leakage and reduced rigidity of the cap 31 and the right wall 375 can be inhibited. In the present embodiment, the first gear 381 and the second gear 382 are located adjacently to one another as a result of the shape of the first gear 381, which includes the gear circular tube section 381A. Therefore, drive sections (first transmission gear 211, second transmission gear 212, and third transmission gear 213) for inputting driving force to the first gear 381 and the second gear 382 can be located together in the inner section of the developing device 20.

The cover 39 is attached to the protruding wall 376 of the container body 37. The cover 39 has a function of covering one section of the first gear 381 and the second gear 382 in the circumferential direction while leaving another section of the first gear 381 and the second gear 382 in the circumferential direction externally exposed. As illustrated in FIGS. 15A and 15B, the cover 39 includes the aforementioned second guide section 391, a first protruding plate 392, a second protruding plate 393, a third protruding plate 394, the aforementioned fourth protruding plate 395, a first hole 396, a second hole 397, and a gear opening 39K.

The second guide section 391 is a protrusion that protrudes rightward from a right side surface of the cover 39 and that extends in the up/down direction. The second guide section 391 has a function of guiding attachment of the toner container 30 to the developing device 20 in conjunction with the first guide section 312 of the cap 31. As illustrated in FIG. 10, the tip of the first shaft end 331 is inserted through the second gear 382 and into the second guide section 391.

The first protruding plate 392, the second protruding plate 393, the third protruding plate 394, and the fourth protruding plate 395 are plate-shaped protrusions that protrude leftward from an outer circumferential edge of the cover 39. The first to fourth protruding plates 392-395 are used for snap fitting during attachment of the cover 39 to the container body 37. The first hole 396 and the second hole 397 are openings in a left side surface of the cover 39 that are in proximity to an outer circumferential edge of the left side surface. As illustrated in FIG. 14, the container body 37 further includes a first stud 37P and a second stud 37Q that each protrude rightward in a pin-like shape. When the cover 39 is attached to the container body 37, positioning of the cover 39 in the circumferential direction is fixed by insertion of the first stud 37P and the second stud 37Q into the first hole 396 and the second hole 397.

As illustrated in FIG. 15A, the gear opening 39K is a semicircular arc-shaped opening in a bottom surface section of the cover 39. In a state in which the cover 39 is attached to the container body 37, some of the gear teeth of the first gear 381 and the second gear 382 are exposed to outside of the toner container 30 through the gear opening 39K. As a result, in a state in which the toner container 30 is attached to the development housing 210 of the developing device 20, the first gear 381 and the second gear 382 engage with the second transmission gear 212 and the third transmission gear 213 (FIG. 7). Provision of the gear opening 39K described above enables rotational driving force to be input to the first gear 381 and the second gear 382 while also protecting the first gear 381 and the second gear 382.

The toner sensor TS (FIGS. 8B, 16A, and 16B) is located on the bottom section 371 of the container body 37. The toner sensor TS is located adjacently to the toner discharge outlet 377 in the circumferential direction. In the present embodiment, the toner sensor TS is fixed to a lowermost surface of the bottom section 371. The toner sensor TS is a magnetic permeability sensor or a sensor formed from a piezoelectric element. In a configuration in which the toner sensor TS is formed from a piezoelectric element, a sensing part of the toner sensor TS is exposed in the containment space 37S. The toner sensor TS outputs a HIGH signal (+5 V) in response to toner in the containment space 37S pressing against the toner sensor TS. The toner sensor TS outputs a LOW signal (0 V) in a situation in which almost no toner is present above the toner sensor TS. The control section 50 (FIG. 7) uses the output signal of the toner sensor TS as a reference. In a configuration in which the toner sensor TS is a magnetic permeability sensor, it is not necessary for the toner sensor TS to be in direct contact with the toner. Therefore, in another embodiment, the toner sensor TS may be provided on the development housing 210 of the developing device 20 at a position opposite to an outer wall of the container body 37. Note that the toner sensor TS is not limited to being located on the bottom section 371. In another embodiment, a toner sensor TS may, for example, be located on the top plate 372, the front wall 373, or the rear wall 374 of the container body 37.

<Toner Container Assembly>

The following provides a rough explanation of a procedure for assembling the toner container 30. The first shaft end 331 of the shaft 33 is inserted through the first seal 34 as illustrated in FIG. 9. The first seal 34 abuts against the shaft flanges 336. The stirrer bearing 351 of the stirring member 35 is inserted through the second seal 36. The second seal 36 abuts against the ring shaped protrusion at the base end of the stirrer support section 352. The first shaft end 331 of the shaft 33 is also inserted through the stirrer bearing 351 of the stirring member 35. Next, the second shaft end 332 of the shaft 33 is inserted through the moveable wall 32. The moveable wall 32 is attached to the shaft 33 while rotating the moveable wall 32 for several rotations in order that the internal thread 320D of the moveable wall 32 engages with the external thread 333 of the shaft 33. With the moveable wall 32, the shaft 33, the first seal 34, the stirring member 35, and the second seal 36 in an integrated state, the first shaft end 331 of the shaft 33 is inserted into the internal space 37H from an end of the container body 37 at which the body flange 37F is located. The first shaft end 331 is inserted through the body bearing 37J such as to protrude from the right end of the container body 37 as illustrated in FIG. 14. Next, the cap welding section 31F of the cap 31 is welded to the body flange 37F of the container body 37 by ultrasonic welding as illustrated in FIGS. 16A and 16B. As a result, the internal space 37H and the containment space 37S are formed in the inner section of the container body 37. The containment space 37S is filled with toner while the filling inlet 37G of the toner container 37 is in an open state.

<Developer Filling>

Figure 17A:
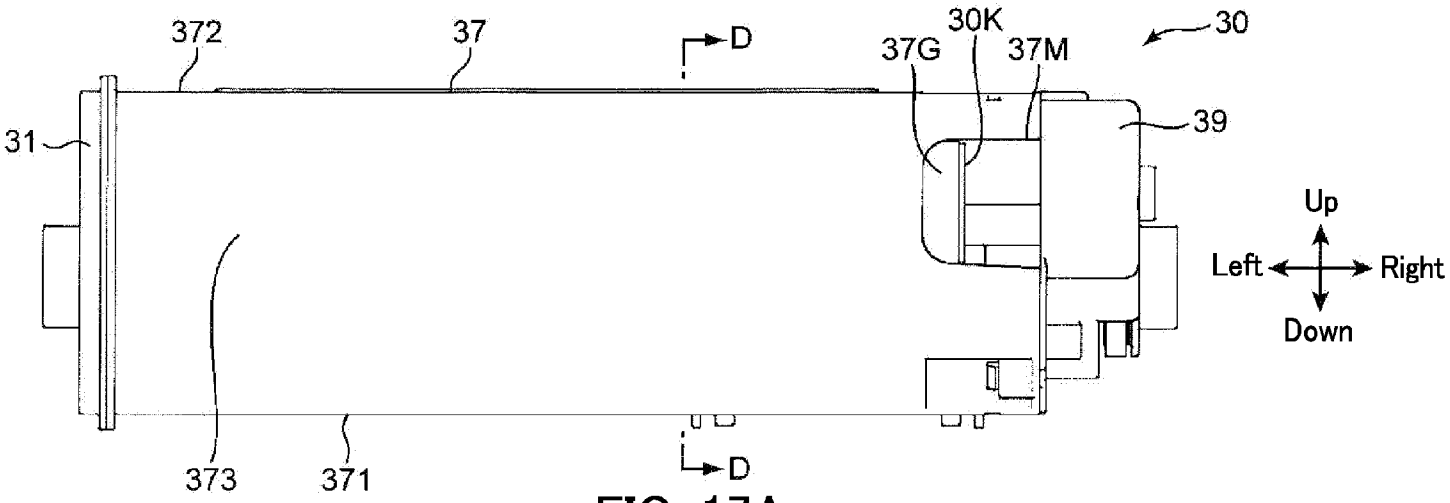
FIG. 17A is a front view illustrating the developer container according to the embodiment of the present disclosure.
Figure 17B:
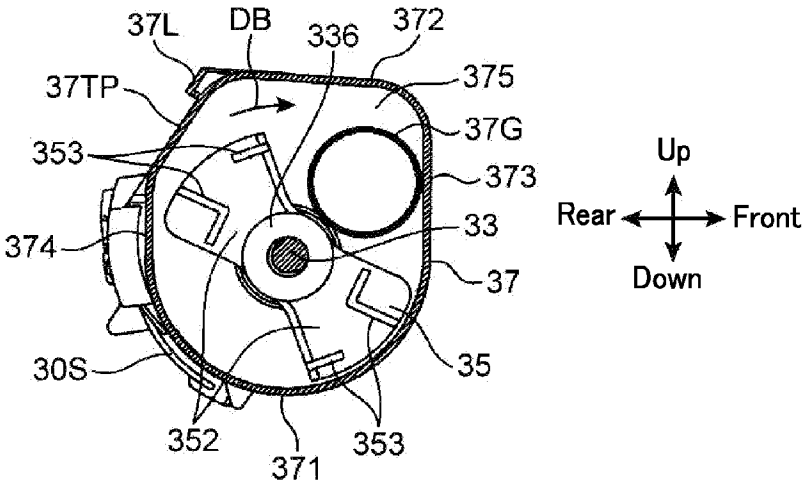
FIG. 17B is a cross-sectional view illustrating the developer container according to the embodiment of the present disclosure.
Figure 18A:
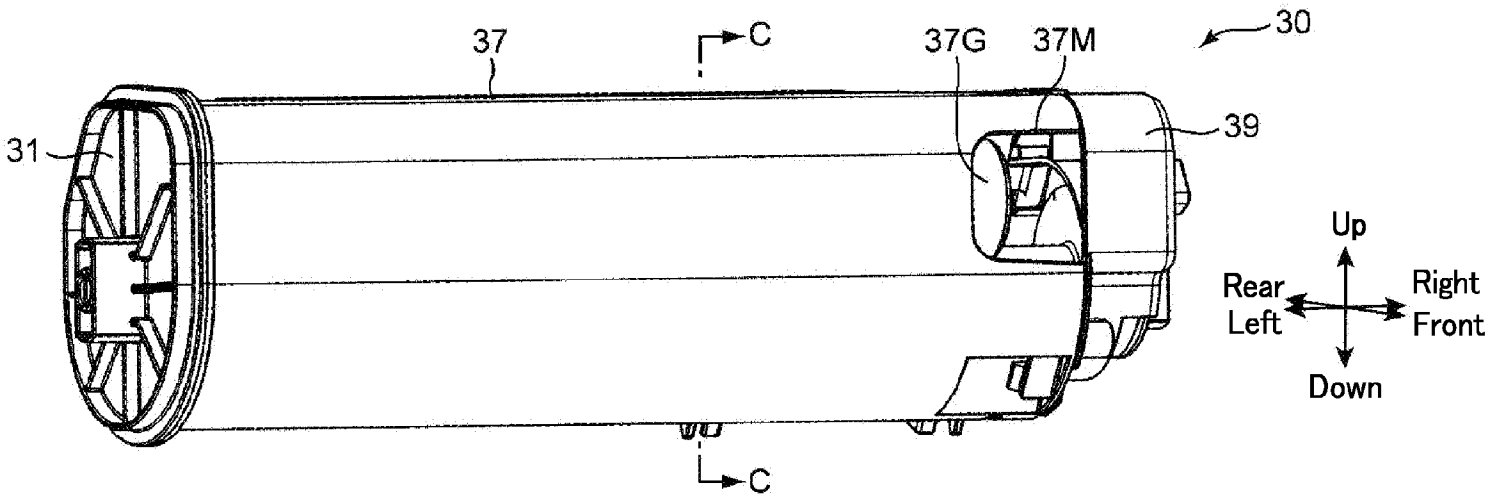
FIG. 18A is a perspective view illustrating the developer container according to the embodiment of the present disclosure.
Figure 18B:
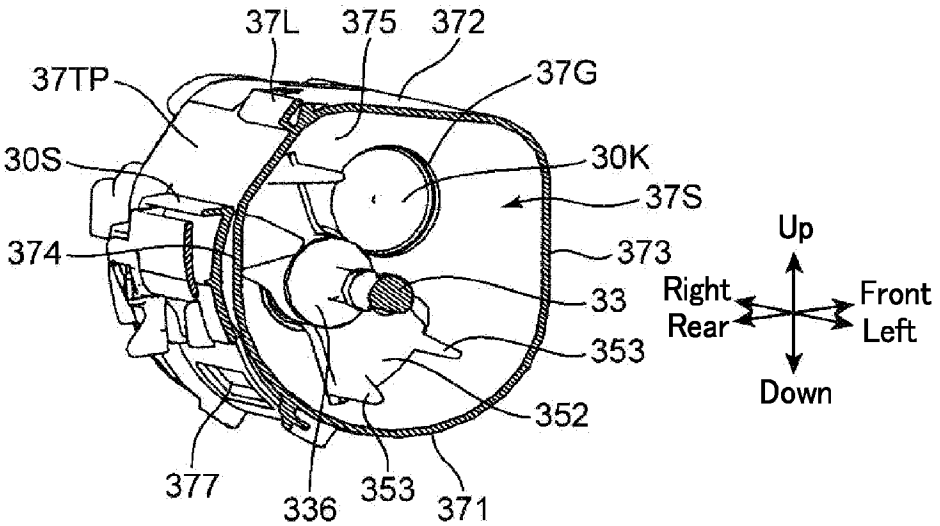
FIG. 18B is a cross-sectional perspective view illustrating the developer container according to the embodiment of the present disclosure.

FIG. 17A is a front view illustrating the toner container 30 according to the present embodiment. FIG. 17B illustrates a cross-section at a position D-D indicated in FIG. 17A. FIG. 18A is a perspective view illustrating the toner container 30. FIG. 18B is a perspective cross-sectional view illustrating the toner container 30 according to the present embodiment. The cross sectional perspective view in FIG. 18B includes a cross-section at a position C-C indicated in FIG. 18A.

As illustrated in FIGS. 17A, 17B, 18A, and 18B, in the present embodiment, when the right wall 375 is viewed from upstream in the first direction (i.e., from the left, from in front of the plane of FIG. 17B), the stirring member 35 is shaped such that the filling inlet 37G is exposed while the stirring member 35 is positioned at a specific rotational position about the shaft 33. More specifically, while the stirring member 35 is positioned at the specific rotational position about the shaft 33 illustrated in FIG. 17B, the filling inlet 37G is exposed through a gap in the circumferential direction between one of the stirrer support sections 352 and the other of the stirrer support sections 352. Therefore, even though the stirring member 35 is provided in a rotatable manner along the right wall 375, the containment space 37S can still be easily filled with toner through the filling inlet 37G by matching a rotational position of the stirring member 35 to the rotational position illustrated in FIGS. 17B and 18B.

Figure 21A:
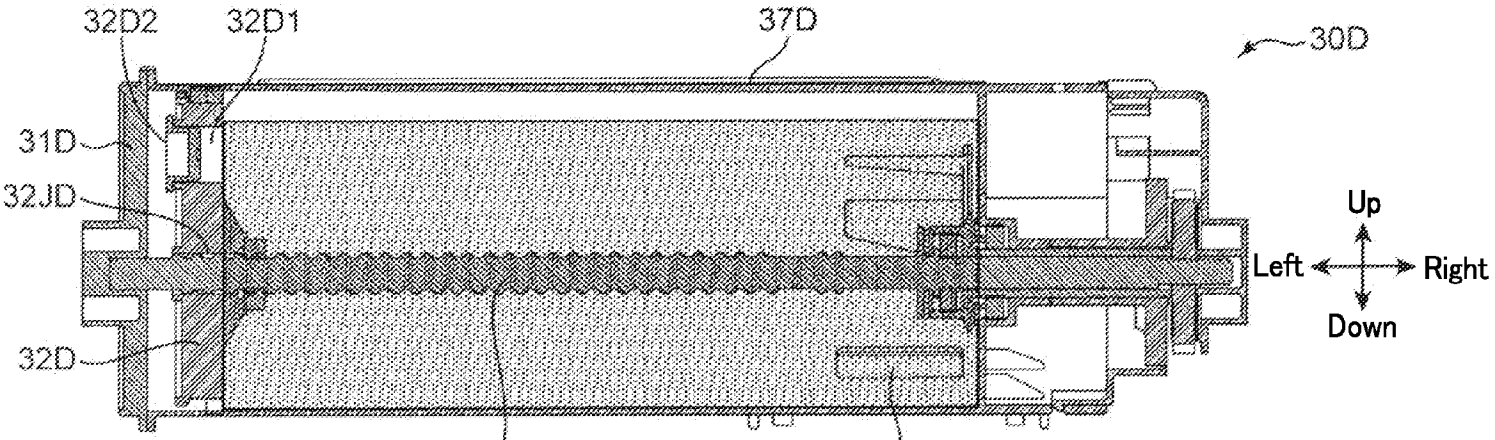
FIGS. 21A and 21B are cross-sectional views each illustrating another developer container for comparison with the developer container according to the embodiment of the present disclosure.
Figure 21B:
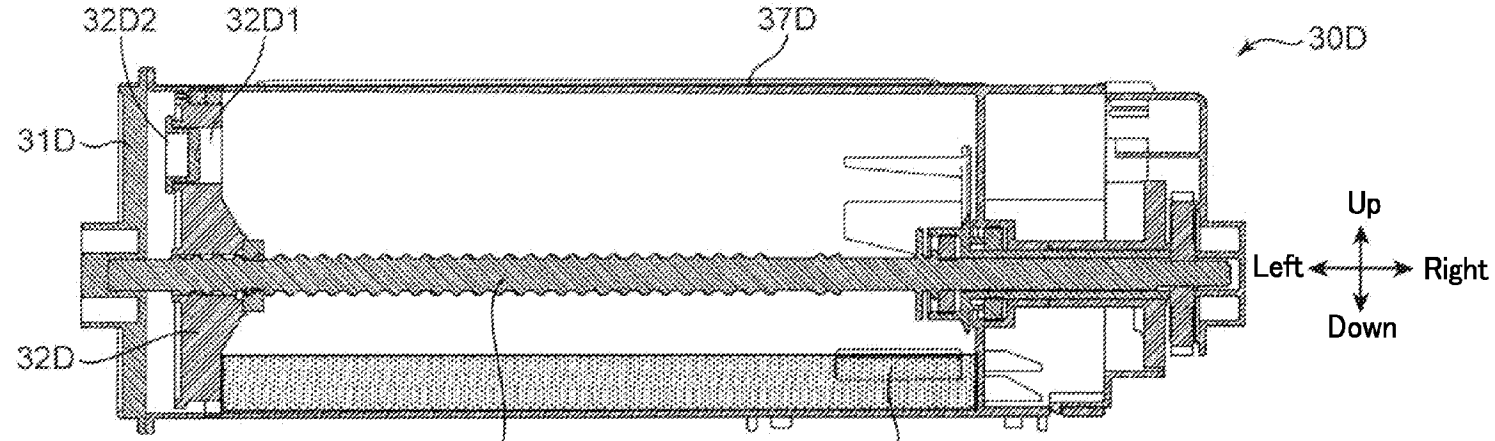
Figure 22A:
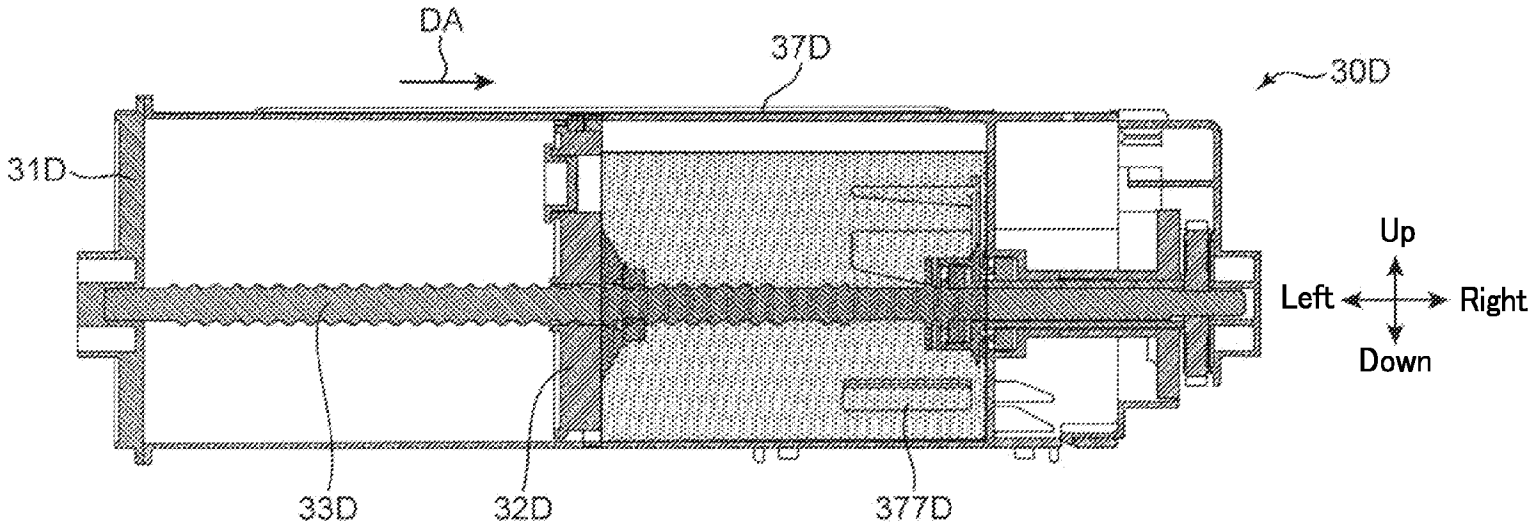
FIGS. 22A and 22B are cross-sectional views each illustrating another developer container for comparison with the developer container according to the embodiment of the present disclosure.
Figure 22B:
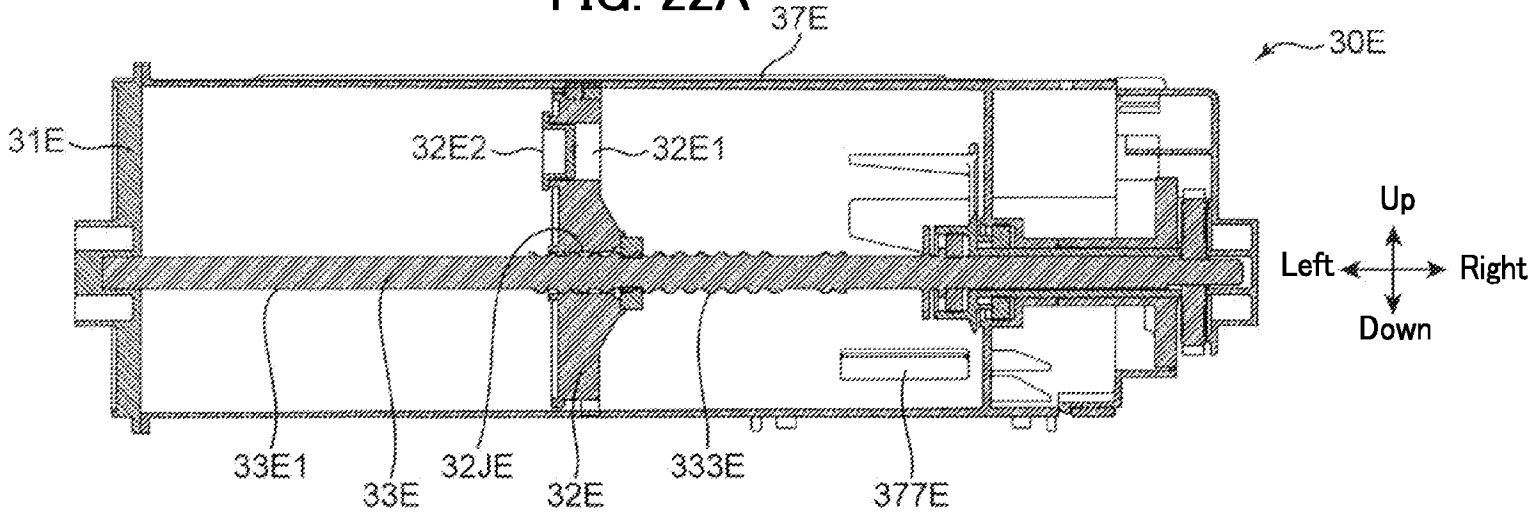

As explained above, the filling inlet 37G for filling the containment space 37S with toner is provided as an opening in the right wall 375 in the present embodiment. FIG. 21A is a cross-sectional view illustrating another toner container 30D used for comparison with the toner container 30 according to the present embodiment. FIG. 21B is another cross-sectional view illustrating the toner container 30D. FIG. 22A is another cross-sectional view illustrating the toner container 30D. FIG. 22B is a cross-sectional view illustrating another toner container 30E used for comparison with the toner container 30 according to the present embodiment.

In the toner container 30D illustrated in FIGS. 21A, 21B, and 22A, a filling inlet 32D1 for filling toner is provided as an opening in a moveable wall 32D. In such a configuration, toner is filled prior to welding a cap 31D to a container body 37D.

An opening is provided in the moveable wall 32D for a bearing 32JD through which a shaft 33D is inserted. As a result, rigidity of the moveable wall 32D tends to be reduced due to the fact that an opening for the filling inlet 32D1 is also provided in the moveable wall 32D as described above. In a configuration in which rigidity of the moveable wall 32D is low, the moveable wall 32D tends to tilt relative to the shaft 33D while moving along the shaft 33D toward a toner discharge outlet 377D. In contrast to such a configuration, an opening for the filling inlet 37G is provided in the right wall 375 in the present embodiment (FIGS. 18A and 18B). Therefore, high rigidity of the moveable wall 32 can be maintained because it is only necessary to provide an opening for the bearing 32J in the moveable wall 32.

Furthermore, toner containers 30 having a plurality of different settings for the amount of toner filled therein may be installable in the printer 100. In one example in which there are a plurality of different settings for the number of sheets that can be printed using each toner container 30, the amount of toner with which a certain toner container 30 is filled is set in advance in accordance with the number of sheets that the toner container 30 can be used to print. In a situation in which the toner container 30D is to be filled with a large amount of toner, the toner container 30D is filled with the toner while the moveable wall 32D is positioned at the left end of the toner container 30D as illustrated in FIG. 21A. On the other hand, in a situation in which the toner container 30D is filled with a small amount of toner, the filled toner becomes distributed at the bottom of the toner container 30D as illustrated in FIG. 21B. When the toner container 30D containing only a small amount of toner is installed in the printer 100, it is necessary to move the moveable wall 32D to a position illustrated in FIG. 22A before the toner container 30D is used by the printer 100. Therefore, in order to use the toner container 30D described above, time is required to initially move the moveable wall 32D during a production process of the printer 100 or at a point of use by a user. The above configuration leads to an increase in the number of steps in the production process of the printer 100 or lengthening of preparation time at the point of use.

In the toner container 30E illustrated in FIG. 22B, an external thread 333E is located on a central section of a shaft 33E in a first direction. A region 33E1 in which the external thread 333E is not present and in which only an axial part of the shaft 33E is present is set at a left end of the shaft 33E. In such a configuration, a bearing 327E of a moveable wall 32E can be moved through the region 33E1 to position the moveable wall 32E at a position illustrated in FIG. 22B in advance. However, in the above situation, toner is filled through a filling inlet 32E1 while in the state illustrated in FIG. 22B and, as a consequence, it is necessary to insert filling equipment (i.e., a nozzle) into an inner section of the toner container 30E. Therefore, the filling equipment needs to have a more complicated shape. In particular, in a configuration in which a long, thin filling nozzle is provided in order to reach the filling inlet 32E1, clogging of the nozzle has a high tendency to occur. In addition, filling efficiency is reduced due to the moveable wall 32E having a high tendency to move during filling. Furthermore, welding of a filling inlet cap 32E2 to the filling inlet 32E1 is complicated due to the position of the moveable wall 32E being unstable. In contrast, the filling inlet 37G in the present embodiment is provided in the right wall 375 and toner is filled from the end corresponding to the right wall 375, which is fixed in place irrespective of the amount of toner that is filled. Furthermore, in assembly of the toner container 30, the shaft 33 can be attached in the inner section of the container body 37 in a state in which the moveable wall 32 has been positioned in advance at a specific position in the first direction along the shaft 33. Therefore, an initial size of the containment space 37S is preset before toner is filled through the filling inlet 37G. As described above, according to the present embodiment, even in a situation in which there are a plurality of different settings for the amount of toner with which the containment space 37S can be filled and a plurality of different settings for the initial position of the moveable wall 32, filling operation can be performed reliably using the same filling equipment for each setting.

<Moveable Wall Movement>

When a user attaches the toner container 30 to the container accommodating section 109, the user guides the first guide section 312 of the cap 31 and the second guide section 391 of the cover 39 along the pair of guide grooves 109A of the developing device 20 (FIGS. 6 and 7). During attachment of the toner container 30 to the container accommodating section 109, the shutter 30S is moved so as to open the toner discharge outlet 377. Once the toner container 30 is attached, the toner discharge outlet 377 is located above and opposite to the toner replenishment inlet 25 (FIGS. 4 and 5).

Figure 19A:
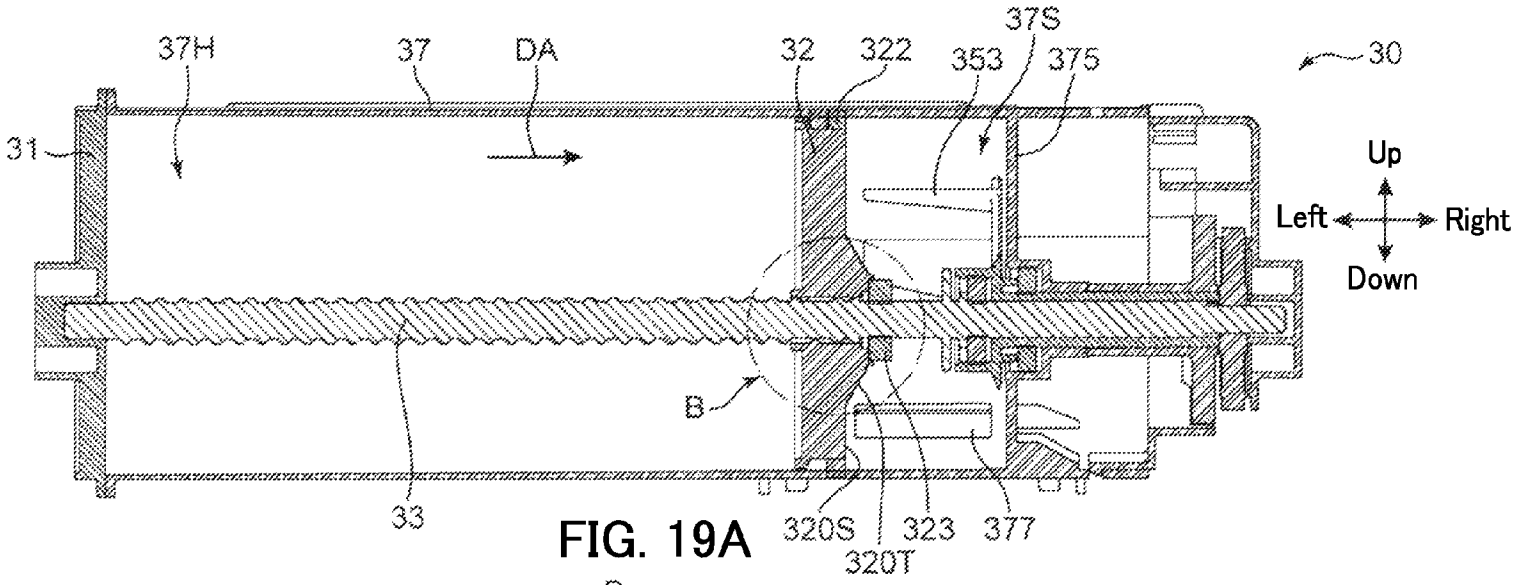
FIG. 19A is a cross-sectional view illustrating the developer container according to the embodiment of the present disclosure.
Figure 19B:
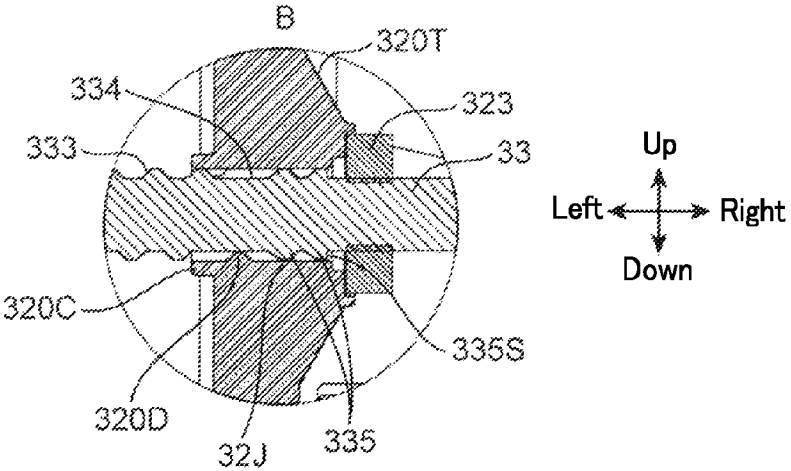
FIG. 19B is an enlarged cross-sectional view illustrating the developer container according to the embodiment of the present disclosure.

FIG. 19A is a cross-sectional view illustrating a situation in which the moveable wall 32 is positioned at the final position in the toner container 30. FIG. 19B is an enlarged cross-sectional view illustrating the situation in which the moveable wall 32 is positioned at the final position in the toner container 30. Note that FIG. 10 explained above illustrates a situation in which the moveable wall 32 has moved partway in the first direction from the initial position. The initial position of the moveable wall 32 is with the moveable wall 32 positioned along the cap 31, which in other words is a position leftward of the position of the moveable wall 32 illustrated in FIG. 10.

When the toner container 30 is newly installed in the printer 100, the control section 50 (FIG. 7) drives the first motor M1 to rotationally drive the shaft 33 through the second gear 382 that engages with the third transmission gear 213. As a result, the moveable wall 32 moves in the first direction (arrow DA in FIG. 10), toward the toner discharge outlet 377, through engagement of the external thread 333 of the shaft 33 with the internal thread 320D of the moveable wall 32. Once the moveable wall 32 has moved a specific distance rightward from the initial position, the containment space 37S reaches a full state and the toner sensor TS outputs a HIGH signal in response to the full state. The control section 50 receives the HIGH signal output by the toner sensor TS and stops the moveable wall 32.

In the present embodiment, the inner circumferential section 37K of the container body 37 and the outer circumferential section 32K of the moveable wall 32 do not have a perfectly circular shape in a cross-section perpendicular to the first direction. More specifically, the inner circumferential section 37K of the container body 37 is formed by the bottom section 371, the top plate 372, the front wall 373, and the rear wall 374 of the container body 37 as illustrated in FIG. 17A. Furthermore, an upper section of the rear wall 374 is an inclined section 37TP. The inclined section 37TP is recessed toward the inner section of the container body 37. As a result, the container body 37 does not have lateral symmetry in a vertical plane passing through the shaft 33. The holding section 37L is located at an upper end of the inclined section 37TP. A user can hold the toner container 30 by gripping the holding section 37L and the front wall 373.

The outer circumferential section 32K of the moveable wall 32, which is in sealed contact with the inner circumferential section 37K of the container body 37, has a shape matching the shape of the inner circumferential section 37K. As a result of the above configuration, the moveable wall 32 is prevented from rotating around the shaft 33 (i.e., drag turning of the moveable wall 32 is prevented), even when rotational force around the shaft 33 is imparted on the moveable wall 32 through engagement of the external thread 333 with the internal thread 320D. Therefore, the moveable wall 32 can be stably moved in the first direction through rotational driving force of the first motor M1. Furthermore, the moveable wall 32 can be stably moved in the first direction as described above, with the outer circumferential section 32K of the moveable wall 32 in sealed contact with the inner circumferential section 37K of the container body 37 through engagement of the external thread 333 with the internal thread 320D.

When the moveable wall 32 moves in the first direction (arrow DA in FIG. 10) through engagement of the external thread 333 with the internal thread 320D, reaction force (thrust force) is imparted on the shaft 33 in the direction indicated by arrow DJ in FIG. 10. Therefore, the end surface of the second shaft end 332 of the shaft 33 abuts against the abutment section 311 of the cap 31 while the moveable wall 32 is moving. As a result, the abutment section 311 performs a function of limiting the position of the shaft 33 in a first direction. In the present embodiment, the cap 31 is welded to the body flange 37F (FIG. 9) of the container body 37 through ultrasonic welding. Welding of the cap 31 prevents the cap 31 from detaching from the container body 37, even if the shaft 33 pushes strongly leftward against the cap 31. In the present embodiment, the abutment section 311 that restricts position of the shaft 33 is located further upstream in the first direction than the moveable wall 32. Therefore, toner is prevented from flowing between the shaft 33 and the abutment section 311 at a position at which the shaft 33 and the abutment section 311 are in contact. Such a configuration prevents poor rotation of the shaft 33, which might otherwise occur due to toner adhesion in the abutment section 311.

As explained above, volume replenishment-type toner replenishment is adopted in the present embodiment as illustrated in FIG. 5. Therefore, replenishment toner does not drop from the toner container 30 in a situation in which the stagnant region 29 (FIG. 5) in the developing device 20 blocks the toner replenishment inlet 25 from below. On the other hand, toner flows into the developing device 20 through the toner discharge outlet 377 and the toner replenishment inlet 25 in response to a decrease in the amount of toner in the stagnant region 29 when toner is supplied to the photosensitive drum 121 from the development roller 21 of the developing device 20. In the containment space 37S of the toner container 30, the amount of toner in proximity to the toner sensor TS decreases as a result of toner flowing out through the toner discharge outlet 377, causing the toner sensor TS to output a LOW signal. The control section 50 receives the LOW signal and moves the moveable wall 32 toward the toner discharge outlet 377 by driving the first motor M1 until the toner sensor TS outputs a HIGH signal.

The control section 50 drives the second motor M2 to rotationally drive the development roller 21 and the like in accordance with development operation of the developing device 20. In conjunction with the rotational driving described above, the stirring member 35 is caused to rotate through the first gear 381, which engages with the second transmission gear 212. As a result, toner above the toner discharge outlet 377 is reliably stirred by the stirring member 35, which is located at the right end of the containment space 37S, rotating around the shaft 33. The stirring increases the fluidity of the toner and ensures reliable dropping of the toner through the toner discharge outlet 377. More specifically, in the present embodiment, the stirring blades 353 protrude from the stirrer support sections 352 of the stirring member 35. Such a configuration achieves vigorous stirring of toner in proximity to the toner discharge outlet 377 through circulatory movement of the stirring blades 353.

The moveable wall 32 eventually reaches the final position illustrated in FIGS. 19A and 19B as a result of continued use of toner in the containment space 37S of the toner container 30. As described above, the toner in the containment space 37S is conveyed to the toner discharge outlet 377 by the moveable wall 32 pushing against the toner as the moveable wall 32 gradually moves in the first direction. During movement of the moveable wall 32, the containment space 37S gradually decreases in size until the moveable wall 32 reaches the final position. In other words, a space in the inner section of the toner container 30 in which toner can remain gradually disappears. As a result of the above configuration, the amount of toner remaining in the containment space 37S of the container body 37 at the end of use is small compared to a generic toner container in which the capacity of a containment space does not change.

In the present embodiment, the moveable wall 32 is stopped at the final position, slightly upstream in the first direction of the toner discharge outlet 377 as illustrated in FIG. 19A. More specifically, once the bearing 32J of the moveable wall 32 reaches the moveable wall stopping section 334 through movement of the moveable wall 32, the external thread 333 disengages from the internal thread 320D as illustrated in FIG. 19B. As a result, transmission of movement force from the shaft 33 to the moveable wall 32 is cut off, stopping the moveable wall 32 at the final position. In the above situation, a space containing a small amount of toner remains above the toner discharge outlet 377. However, according to the present embodiment, toner can be reliably discharged from the toner discharge outlet 377 up until the end of use through rotational driving of the stirring member 35. The toner discharge outlet 377 is provided at a position that is slightly higher than a lowermost part of the container body 37. Even in such a configuration, toner remaining at the bottom of the container body 37 is scooped up and reliably discharged through the toner discharge outlet 377 by the stirring blades 353 (FIGS. 17A, 17B, 18A, and 18B).

Figure 23:
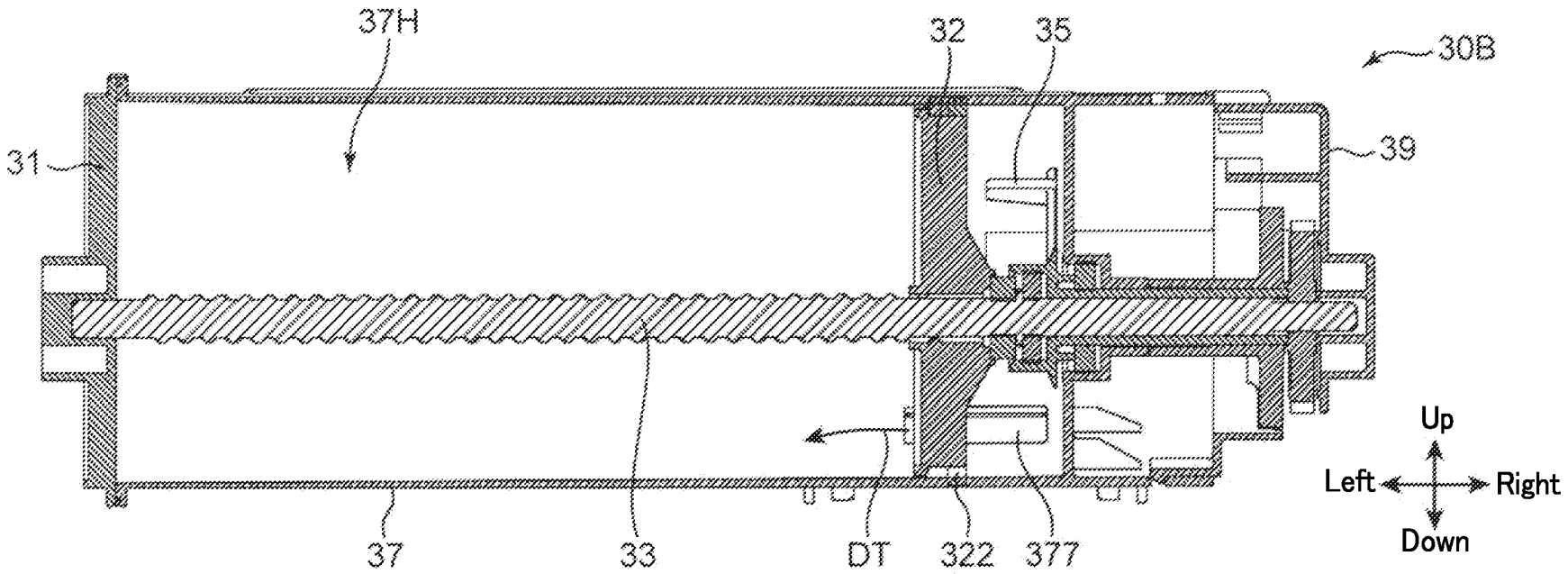
FIG. 23 is a cross-sectional view illustrating another developer container for comparison with the developer container according to the embodiment of the present disclosure.

When the moveable wall 32 is at the final position, an upstream end in the first direction of the outer circumferential section 32K (FIG. 10) of the moveable wall 32 is located further upstream in the first direction than an upstream end in the first direction of the toner discharge outlet 377. More specifically, in the present embodiment, an upstream end in the first direction of the inner wall seal 322 is located further upstream in the first direction than the upstream end in the first direction of the toner discharge outlet 377. FIG. 23 is a cross-sectional view illustrating a toner container 30B used for comparison with the toner container 30 according to the present embodiment. FIG. 23 illustrates the toner container 30B in a state in which a moveable wall 32 of the toner container 30B is at a final position. When the moveable wall 32 is at the final position in the toner container 30B, an upstream end in a first direction of an inner wall seal 322 of the moveable wall 32 is located further downstream in the first direction than an upstream end in the first direction of a toner discharge outlet 377. Therefore, toner that has been discharged through the toner discharge outlet 377 may mistakenly flow into an internal space 37H upstream of the moveable wall 32 as indicated by arrow DT in FIG. 23. Such flow of toner is reliably prevented in the present embodiment by setting the positional relationship of the toner discharge outlet 377 and the moveable wall 32 at the final position as described further above. In a situation in which volume replenishment-type toner replenishment is adopted as described above for the present embodiment, pressing force from the toner container 30 to the developing device 20 of replenishment toner pressing on the stagnant region 29 is lost once the toner container 30 is emptied of toner. Depending on conditions in the developing device 20, reverse flow of toner from the developing device 20 may occur in such a situation through the toner replenishment inlet 25 and the toner discharge outlet 377. The final position of the moveable wall 32 ensures that even when reverse flow of toner is likely to occur such as described above, the toner is prevented from flowing into the internal space 37H upstream of the moveable wall 32.

Furthermore, when the moveable wall 32 is at the final position as illustrated in FIG. 19A, the conveying surface 320S of the moveable wall 32 is positioned upstream in the first direction of the stirring blades 353 of the stirring member 35 with a gap therebetween. The above configuration prevents the conveying surface 320S of the moveable wall 32 from interfering with the stirring member 35 while the moveable wall 32 is at the final position. Therefore, toner agglomeration can be prevented while also preventing the stirring member 35 from scraping against the moveable wall 32 in a situation in which the stirring member 35 continues rotating in order to discharge toner remaining in the container body 37. The above configuration also prevents interference between the moveable wall 32 and the stirring member 35 in a situation in which the stirring member 35 continues to rotate in synchronization with the development roller 21 due to use of the developing device 20 continuing for a specific period of time once the toner container 30 is empty. As described further above, the moveable wall stopping section 334 of the shaft 33 reliably stops the moveable wall 32 at the final position. Such a configuration further helps to prevent interference between the moveable wall 32 and the stirring member 35. Furthermore, as illustrated in FIG. 19A, when the moveable wall 32 is at the final position, the inner wall seal 322 of the moveable wall 32 is pressed against the inner circumferential section 37K of the toner container 30 through elastic force in the radial direction. Therefore, the moveable wall 32 is stably locked in the final position and the moveable wall 32 is prevented from moving further toward the stirring member 35.

FIG. 19A illustrates that in the present embodiment, upstream ends in the first direction of the stirring blades 353 of the stirring member 35 are located slightly downstream in the first direction of the upstream end in the first direction of the toner discharge outlet 377. In another embodiment, the upstream ends in the first direction of the stirring blades 353 of the stirring member 35 may be located at the same position in the first direction as the upstream end in the first direction of the toner discharge outlet 377. By setting the positions of the stirring blades 353 and the toner discharge outlet 377 as described above, reliable stirring and discharge of toner in proximity to the toner discharge outlet 377 can be achieved. Furthermore, as a consequence of the stirring blades 353 not protruding further upstream in the first direction than the toner discharge outlet 377, the final position of the moveable wall 32 can be set as close as possible to the toner discharge outlet 377.

In the present embodiment, the conveying surface 320S of the moveable wall 32 includes the aforementioned tapered surface 320T (FIG. 19A). In addition, the shaft seal 323 is located at the tip of the tapered surface 320T. When the moveable wall 32 is at the final position, a downstream end in the first direction of the shaft seal 323 is located further downstream in the first direction than the upstream end in the first direction of the toner discharge outlet 377. Through the configuration described above, the final position of the moveable wall 32 can be set even closer to the toner discharge outlet 377 by setting the final position such that the tapered surface 320T and the shaft seal 323 are present in an inward radial direction from the stirring blades 353 when the moveable wall 32 is at the final position. Also, the moveable wall stopping section 334 and the moveable wall support section 335 of the shaft 33 can be easily provided at positions in the first direction that are opposite to the bearing 32J of the moveable wall 32. In other words, provision of the tapered surface 320T enables thickness of the moveable wall 32 in the first direction to be increased, thereby increasing length in the first direction of a region in which the moveable wall stopping section 334 and the moveable wall support section 335 can be positioned. In addition, provision of the tapered surface 320T enables the shaft seal 323 to be positioned downstream in the first direction of the internal thread 320D with a gap therebetween. Therefore, excessive leakage of toner into the internal thread 320D can be prevented.

Figure 24A:
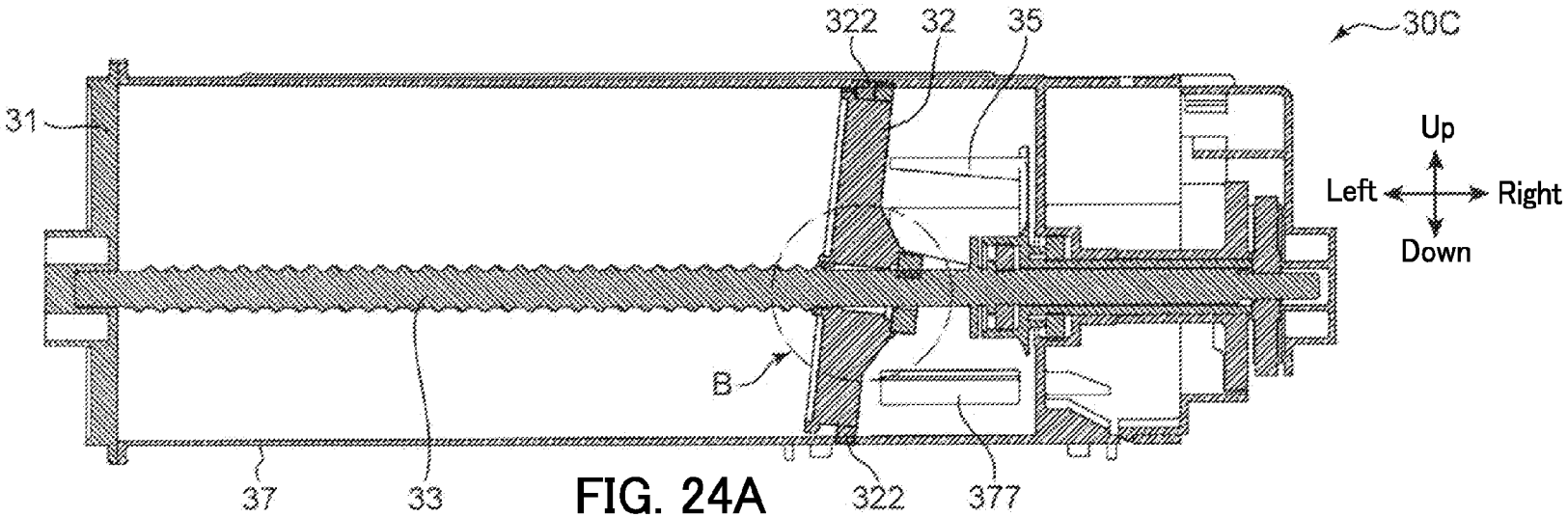
FIG. 24A is a cross-sectional view illustrating another developer container for comparison with the developer container according to the embodiment of the present disclosure.
Figure 24B:
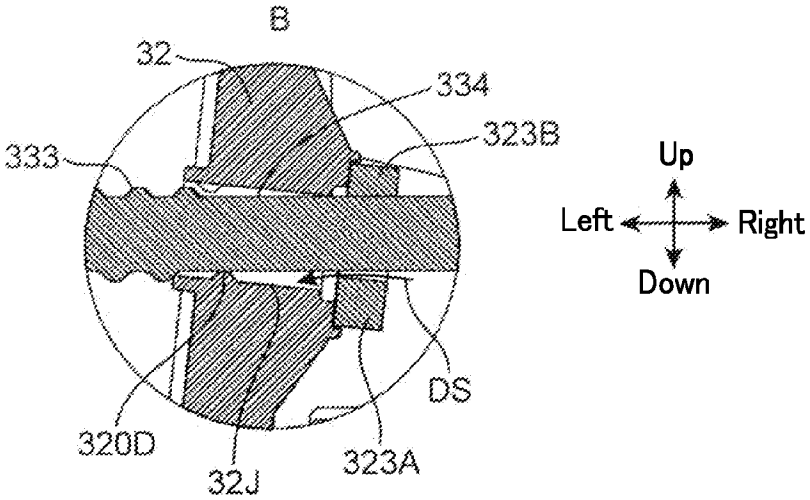
FIG. 24B is an enlarged cross-sectional view illustrating another developer container for comparison with the developer container according to the embodiment of the present disclosure.

In the present embodiment, the bearing 32J is supported by a downstream end in the first direction of the external thread 333 and also by the moveable wall support section 335, which is located downstream in the first direction of the moveable wall stopping section 334. Therefore, the moveable wall 32 is restricted from tilting relative to the shaft 33 when the moveable wall 32 has reached the final position. In particular, the conveying surface 320S of the moveable wall 32 is restricted from tilting relative to the first direction. FIGS. 24A and 24B are cross-sectional views illustrating a toner container 30C used for comparison with the toner container 30 according to the present embodiment. The toner container 30C differs from the toner container 30 in terms that the toner container 30C does not include the moveable wall support section 335 described in the present embodiment. FIGS. 24A and 24B illustrate that in the toner container 30C, an internal thread 320D disengages from an external thread 333 when a moveable wall 32 reaches a final position. In such a situation, the moveable wall 32 tilts as illustrated in FIG. 24B due to a large gap between an inner circumferential surface of a bearing 32J and an outer circumferential surface of a moveable wall stopping section 334. Tilting of the moveable wall 32 causes a lower section 323A of a shaft seal 323 located at a tip of the bearing 32J to separate from the moveable wall stopping section 334, allowing toner to leak into the bearing 32J as indicated by arrow DS and making is easier for the toner to subsequently flow upstream in the first direction of the moveable wall 32. In the same way, an upper section 323B of the shaft seal 323 presses excessively against the moveable wall stopping section 334, causing significant deformation of the shaft seal 323. Such deformation makes it easier for toner to leak into the bearing 32J in the same way as described above. Furthermore, tilting of the moveable wall 32 relative to the shaft 33 results in a change in the amount of compression of the inner wall seal 322 located at the outer circumferential section 32K of the moveable wall 32. As a result, it becomes easier for toner to flow upstream in the first direction, between the container body 37 and the moveable wall 32.

In contrast, the shaft 33 in the present embodiment includes the moveable wall support section 335 as explained further above. Therefore, uneven deformation of the inner wall seal 322 and the shaft seal 323 is inhibited while also restricting tilting of the moveable wall 32. Consequently, toner is prevented from flowing upstream of the moveable wall 32 through the body bearing 37J or between the moveable wall 32 and the inner circumferential section 37K of the container body 37. Preventing the moveable wall 32 from tilting also helps to prevent interference of the stirring member 35 and the conveying surface 320S of the moveable wall 32 while the moveable wall 32 is at the final position.

The height by which the moveable wall support section 335 protrudes from the shaft 33 is preferably the same as the height of the crests of the external thread 333 or slightly higher than the height of the crests of the external thread 333. Such a configuration ensures that the moveable wall support section 335 reliably supports the bearing 32J. In addition, the moveable wall support section 335 has a ring shape extending along the circumferential surface of the shaft 33 in the circumferential direction and, as a result, the moveable wall support section 335 reliably supports the bearing 32J along the entirety of the circumferential direction.

As illustrated in FIGS. 13 and 19B, the moveable wall support section 335 is provided at a plurality of positions in the first direction such that the bearing 32J is reliably supported along a specific range in the first direction. The side surface 335C (FIG. 13) of the second support section 335B of the moveable wall support section 335 is perpendicular to the first direction. Therefore, the moveable wall support section 335 can support the bearing 32J as far downstream in the first direction as possible. As a result, the final position of the moveable wall 32 can be set even closer to the toner discharge outlet 377.

According to the configuration of the present embodiment, the outer circumferential section 32K of the moveable wall 32 is in sealed contact with the inner circumferential section 37K of the container body 37. Also, developer in the containment space 37S is conveyed to the developer discharge outlet (toner discharge outlet 377) through movement of the moveable wall 32 in the first direction. The containment space 37S gradually decreases in size as the moveable wall 32 moves toward the final position. As a result, the amount of the developer remaining in the containment space 37S of the container body 37 at the end of use is reduced. Furthermore, when the moveable wall 32 is stopped at the final position through disengagement of the external thread 333 from the internal thread 320D, the tilt restricting mechanism (moveable wall support section 335) restricts the conveying surface 320S of the moveable wall 32 from tilting relative to the first direction. Therefore, the developer in the containment space 37S is prevented from flowing upstream of the moveable wall 32 by passing through the bearing 32J or between the moveable wall 32 and the inner circumferential section 37K of the container body 37.

According to the configuration of the present embodiment, the shaft elastic member (shaft seal 323) enables the external thread 333 to engage with the internal thread 320D in a state in which almost all developer has been removed from the external thread 333. Therefore, reliable movement of the moveable wall 32 is achieved. In addition, a sealing function of the shaft elastic member (shaft seal 323) prevents the developer in the containment space 37S from flowing upstream of the moveable wall 32 by passing through the bearing 32J. Furthermore, the tilt restricting mechanism (moveable wall support section 335) inhibits excessive load from acting on the shaft elastic member (shaft seal 323) when the moveable wall 32 has reached the final position. Therefore, uneven deformation of the shaft elastic member (shaft seal 323) is inhibited, thereby further helping to prevent developer from flowing upstream of the moveable wall 32 by passing through the bearing 32J.

According to the configuration of the present embodiment, the developer in the containment space 37S is prevented from flowing upstream of the moveable wall 32 during movement of the moveable wall 32 by passing between the moveable wall 32 and the inner circumferential section 37K of the container body 37. Furthermore, the tilt restricting mechanism (moveable wall support section 335) inhibits excessive load from acting on the inner wall elastic member (inner wall seal 322) when the moveable wall 32 has reached the final position. Therefore, uneven deformation of the inner wall elastic member (inner wall seal 322) is inhibited, thereby further helping to prevent developer from flowing upstream of the moveable wall 32 by passing between the moveable wall 32 and the inner circumferential section 37K of the container body 37.

According to the configuration of the present embodiment, the moveable wall 32 is reliably restricted from tilting due to the bearing 32J being supported by the protrusions (first support section 335A, second support section 335B).

According to the configuration of the present embodiment, the bearing 32J is reliably supported by the protrusions (first support section 335A, second support section 335B) when the moveable wall 32 has reached the final position. Therefore, the moveable wall 32 can be more reliably restricted from tilting.

According to the configuration of the present embodiment, the bearing 32J is reliably supported by the protrusions (first support section 335A, second support section 335B) along the entirety of the circumferential direction.

According to the configuration of the present embodiment, the bearing 32J is reliably supported by the protrusions (first support section 335A, second support section 335B) over a specific range in the first direction.

According to the configuration of the present embodiment, a position at which the protrusions (first support section 335A, second support section 335B) are in contact with the bearing 32J can be provided as far downstream in the first direction as possible. Therefore, the final position of the moveable wall 32 can be set closer to the developer discharge outlet (toner discharge outlet 377).

According to the configuration of the present embodiment, the amount of developer remaining in the containment space 37S of the container body 37 at the end of use is reduced. Furthermore, while the moveable wall 32 is stopped at the final position, developer is prevented from flowing upstream of the moveable wall 32 by passing through the bearing 32J or between the moveable wall 32 and the inner circumferential section 37K of the container body 37. Therefore, images are formed on sheets while efficiently using the developer in the developer container (toner container 30).

Through the above, explanation has been provided of the toner container 30 according to the embodiment of the present disclosure and the printer 100 including the toner container 30, but the present disclosure is not limited to the toner container 30 and the printer 100. For example, alternative embodiments such as described below may be adopted.

(1) Although the printer 100 is described as a monochrome printer in the above embodiment (referred to below as a first embodiment), the present disclosure is not limited to such a configuration. Specifically, in a configuration in which the printer 100 is a tandem color printer, after the openable cover 100C (FIG. 2) of the printer 100 has been opened, toner containers 30 containing toners of a plurality of different colors may be attached next to one another within the casing 101 from above.

(2) Although explanation is provided for volume replenishment-type toner replenishment in the first embodiment, the present disclosure is not limited to such a configuration. In an alternative configuration, the developing device 20 may include a toner sensor (not illustrated). When a decrease in toner in the developing device 20 is detected through the toner sensor, the control section 50 drives the first motor M1 such that the moveable wall 32 moves in the first direction. As a result, toner drops through the toner discharge outlet 377 and flows into the developing device 20.

(3) Although the first embodiment is explained for a configuration in which the bearing 32J is located in an approximately central section of the moveable wall 32, the present disclosure is not limited to such a configuration. The bearing 32J may be located in a different region of the moveable wall 32. In an alternative configuration, the bearing 32J may be located in an upper section of the moveable wall 32 and the corresponding shaft 33 may extend through an upper section of the container body 37 in the first direction. In such a configuration, the shaft seal 323 (FIGS. 19A and 19B) performs its sealing function more effectively due to the amount of pressure acting thereon due to toner being lower.

(4) Although the first embodiment is explained for a configuration in which the moveable wall 32 moves from the end at which the cap 31 is located to the end at which the right wall 375 is located, the present disclosure is not limited to such a configuration. In an alternative configuration, the toner discharge outlet 377 may be located at the same end as the cap 31 and the moveable wall 32 may move from the end at which the right wall 375 is located to the end at which the cap 31 is located. Furthermore, the stirring member 35 that rotates above the toner discharge outlet 377 is not limited to the shape described in the first embodiment. The stirring member 35 may alternatively have any other shape that enables stirring of toner in proximity to the toner discharge outlet 377.

Figure 20:
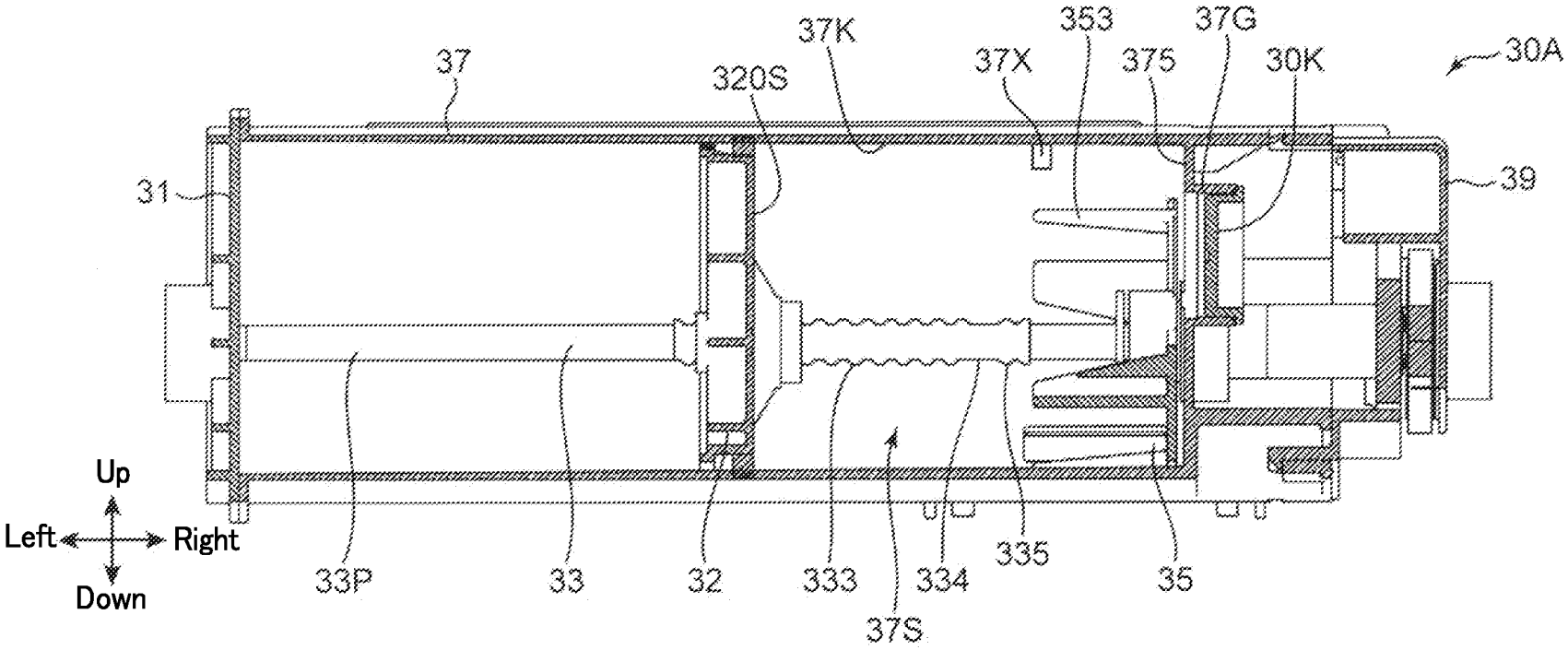
FIG. 20 is a cross-sectional view illustrating a developer container according to an alternative embodiment of the present disclosure.

(5) The first embodiment is explained for a configuration in which the moveable wall support section 335 provided on the shaft 33 functions as a tilt restricting mechanism that maintains the orientation of the moveable wall 32 and restricts tilting of the moveable wall 32. However, the present disclosure is not limited to such a configuration. FIG. 20 is a cross-sectional view illustrating a toner container 30A according to an alternative embodiment of the present disclosure. The alternative embodiment differs from the first embodiment in terms that the toner container 30A includes a protruding member 37X (tilt restricting mechanism) instead of the moveable wall support section 335. The protruding member 37X protrudes in an inward radial direction from the inner circumferential section 37K of the container body 37. In the alternative embodiment, the moveable wall 32 is restricted from tilting when the moveable wall 32 has reached the final position due to the conveying surface 320S abutting against the protruding member 37X.

Furthermore, as illustrated in FIG. 20, the protruding member 37X protrudes downward from a part of the inner circumferential section 37K of the container body 37 that is above the shaft 33. Therefore, compared to a configuration in which a protruding member is provided in a bottom section of the container body 37, the protruding member 37X does not interfere with flow of toner toward the toner discharge outlet 377.

In a situation in which the protruding member 37X is molded with the container body 37, the protruding member 37X illustrated in FIG. 20 may have a rib shape extending as far as the right wall 375 in the first direction. In such a situation, the rib shaped protruding member extending in the first direction is formed when then container body 37 is pulled out of a mold.

In addition, the shaft 33 includes a shaft guide section 33P (FIG. 20) in the present alternative embodiment. The shaft guide section 33P is a region of a specific range at the left end of the shaft 33 in which the external thread 333 is not present. In the toner container 30A, the initial position of the moveable wall 32 is set as the position at which the moveable wall 32 is illustrated in FIG. 20. The amount of toner with which the toner container 30A is filled is approximately half of the amount of toner with which the toner container 30 according to the first embodiment is filled. During assembly of the toner container 30A, the shaft guide section 33P of the shaft 33 passes through the moveable wall 32 such that the moveable wall 32 can be quickly positioned at the initial position without rotating the shaft 33. The initial position of the moveable wall 32 and a position of an upstream end in the first direction of the external thread 333 formed on the shaft 33 are set in accordance with the amount of toner with which the containment space 37S is to be filled. The position of the external thread 333 on the shaft 33 is set such that, compared to a configuration in which the containment space 37S is to be filled with a first mass of toner such as illustrated for the toner container 30A, in a configuration in which the containment space 37S is to be filled with a second mass of toner that is greater than the first mass of toner such as illustrated for the toner container 30, the upstream end in the first direction of the external thread 333 is set further upstream. As a result, the capacity of the containment space 37S can be set in accordance with a preset amount of toner with which the containment space 37S is to be filled.

According to the configuration of the present alternative embodiment, when the moveable wall 32 has reached the final position, the moveable wall 32 is reliably restricted from tilting due to the conveying surface 320S abutting against the protruding member 37X.

According to the configuration of the present alternative embodiment, the protruding member 37X is prevented from interfering with the flow of developer toward the developer discharge outlet (toner discharge outlet 377).

What is claimed is:

1. A developer container comprising:

a container body including an inner circumferential section having a tubular shape extending in a first direction, an internal space defined by the inner circumferential section, and a wall section defining one end surface of the internal space in the first direction;

a cap attached at an opposite end of the container body to the wall section in the first direction, closing the internal space;

a developer discharge outlet through which developer is discharged, the developer discharge outlet being provided in a lower surface of the container body so as to pass through the inner circumferential section and being located in proximity to the cap or the wall section in the first direction;

a shaft having an external thread on an outer circumferential surface thereof, the shaft being rotatably supported on the wall section and the cap such as to extend in the internal space in the first direction;

a drive transmission member configured to transmit rotational driving force to the shaft;

a moveable wall including an outer circumferential section in sealed contact with the inner circumferential section of the container body and a conveying surface at a downstream side in the first direction that, in conjunction with the inner circumferential section of the developer container, defines a containment space in which developer is contained, the moveable wall being configured to move in the first direction from an initial position at one side of the internal space to a final position at another side of the internal space while conveying the developer toward the developer discharge outlet;

a bearing supporting the moveable wall and having an internal thread on an inner circumferential surface thereof that engages with the external thread of the shaft which extends through the bearing;

a moveable wall stopping section located at a position corresponding to the final position of the moveable wall, the moveable wall stopping section being a section of the shaft along which the external thread is not present; and a tilt restricting mechanism configured to restrict the conveying surface of the moveable wall from tilting relative to the first direction when the moveable wall has reached the final position, wherein the tilt restricting mechanism includes at least one protrusion that protrudes from the outer circumferential surface of the shaft in a radial direction at a position downstream of the moveable wall stopping section in the first direction, when the moveable wall has reached the final position, the moveable wall is restricted from tilting due to the at least one protrusion coming into contact with the inner circumferential surface of the bearing and supporting the inner circumferential surface of the bearing, and upon rotation of the shaft, the moveable wall moves in the first direction along the shaft through engagement of the external thread with the internal thread and when the bearing reaches the moveable wall stopping section, the external thread disengages from the internal thread such that the moveable wall is stopped at the final position.

2. The developer container according to claim 1, further comprising a shaft elastic member having a ring shape that is located downstream of the inner thread of the bearing in the first direction and in contact with the external thread of the shaft.

3. The developer container according to claim 1, further comprising an inner wall elastic member formed along the outer circumferential section of the moveable wall along the entirety of a circumferential direction, the inner wall elastic member being deformed by compression between the inner circumferential section of the container body and the moveable wall.

4. The developer container according to claim 1, wherein the at least one protrusion protrudes from the outer circumferential surface of the shaft by a height that is greater than or equal to a height of crests of the external thread.

5. The developer container according to claim 1, wherein the at least one protrusion has a ring shape that extends in a circumferential direction along the outer circumferential surface of the shaft.

6. The developer container according to claim 1, wherein the tilt restricting mechanism includes a plurality of the protrusions that are arranged in the first direction.

7. The developer container according to claim 6, wherein a furthest downstream of the protrusions in the first direction has a side surface at a downstream side in the first direction that is oriented perpendicularly to the first direction.

8. The developer container according to claim 6, wherein the protrusions include a first protrusion and a second protrusion located downstream of the first protrusion in the first direction, the first protrusion has two inclined surfaces that incline radially inward from a central ridge that is approximately centrally positioned in the first direction in the first protrusion, one of the inclined surfaces being inclined from the central ridge in an upstream direction, the other of the inclined surfaces being inclined from the central ridge in a downstream direction, and the second protrusion has an inclined surface and a side surface, the inclined surface of the second protrusion being inclined radially outward in the downstream direction, the side surface of the second protrusion being adjacent to a downstream end of the inclined surface of the second protrusion in the first direction and being oriented perpendicularly to the first direction.

9. An image forming apparatus comprising:

the developer container according to claim 1;

an image bearing member that has a surface on which an electrostatic latent image is formed and that bears a developer image;

a developing device that receives developer from the developer container and that supplies the developer to the image bearing member; and a transfer section that transfers the developer image onto a sheet from the image bearing member.

10. The developer container according to claim 1, further comprising:

a stirring member located in the internal space of the container body and above the developer discharge outlet, the stirring member being configured to stir the developer in the containment space, wherein the moveable wall is stopped at the final position with a gap between the moveable wall and the stirring member.

* * * * *